US010029436B2

(12) United States Patent
Hirasawa

(10) Patent No.: US 10,029,436 B2
(45) Date of Patent: Jul. 24, 2018

(54) METHOD FOR MANUFACTURING TOILET ROLL PRODUCTS AND TOILET ROLL PRODUCTS

(75) Inventor: Akira Hirasawa, Fujinomiya (JP)

(73) Assignee: Daio Paper Corporation, Ehime (JP)

( * ) Notice: Subject to any disclaimer, the term of this patent is extended or adjusted under 35 U.S.C. 154(b) by 674 days.

(21) Appl. No.: 14/000,724

(22) PCT Filed: Feb. 14, 2012

(86) PCT No.: PCT/JP2012/053335

§ 371 (c)(1),
(2), (4) Date: Aug. 21, 2013

(87) PCT Pub. No.: WO2012/114927

PCT Pub. Date: Aug. 30, 2012

(65) Prior Publication Data

US 2013/0323453 A1 Dec. 5, 2013

(30) Foreign Application Priority Data

Feb. 22, 2011 (JP) ..... 2011-036484

(51) Int. Cl.
*B31F 1/07* (2006.01)
*D21H 27/00* (2006.01)
(Continued)

(52) U.S. Cl.
CPC ..... *B31F 1/07* (2013.01); *D21H 23/48* (2013.01); *D21H 27/005* (2013.01); *A47K 10/16* (2013.01);
(Continued)

(58) Field of Classification Search
None
See application file for complete search history.

(56) References Cited

U.S. PATENT DOCUMENTS 1,779,562 A * 10/1930 Scusa ..... B65H 19/2284 242/421.2
3,203,850 A * 8/1965 McCarty ..... B31F 1/122 162/113
(Continued)

FOREIGN PATENT DOCUMENTS

CN 1890167 A 1/2007
JP 06-181857 A 7/1994
(Continued)

OTHER PUBLICATIONS

European Patent Office, European Search Report, 12750225.0-1308 /2679126, PCT/JP2012053335, Sep. 22, 2015, 5 pages.
English language International Search report dated May 1, 2012.

*Primary Examiner* — Hemant M Desai
*Assistant Examiner* — Mobeen Ahmed
(74) *Attorney, Agent, or Firm* — Renner, Kenner; Arthur M. Reginelli

(57) ABSTRACT

Provided are an electrolytic cathode structure that can suppress the degradation of an activated cathode even if a reverse current flows upon the stoppage of operation of an electrolyzer in an electrode structure allowing the distance between the electrode and an electrode current collector to be maintained at an approximately constant value, and an electrolyzer using the same.

The electrolytic cathode structure includes a metal elastic cushion member 1 compressed and accommodated between an activated cathode 2 and a cathode current collector 3. At least a surface layer of the cathode current collector 3 consumes a larger oxidation current per unit area than the activated cathode. The electrolyzer is partitioned by an ion exchange membrane into an anode chamber for accommo-
(Continued)

dating an anode and a cathode chamber for accommodating a cathode. The electrolytic cathode structure is used for the cathode.

19 Claims, 31 Drawing Sheets

(51) Int. Cl.
*D21H 23/48* (2006.01)
*A47K 10/16* (2006.01)
*D21H 27/30* (2006.01)
*D21H 27/40* (2006.01)
*B31B 70/00* (2017.01)

(52) U.S. Cl.
CPC ..... *B31B 70/006* (2017.08); *B31F 2201/0761* (2013.01); *B65H 2301/41484* (2013.01); *B65H 2701/1762* (2013.01); *D21H 27/30* (2013.01); *D21H 27/40* (2013.01); *Y10T 428/15* (2015.01)

(56) References Cited

U.S. PATENT DOCUMENTS 3,414,459 A * 12/1968 Wells ..... B31F 1/07 156/209
3,867,872 A * 2/1975 Nystrand ..... B31F 1/07 264/248
3,926,299 A * 12/1975 Bradley ..... B65G 1/0442 198/347.3
4,978,565 A * 12/1990 Pigneul ..... B31F 1/07 428/156
5,730,389 A * 3/1998 Biagiotti ..... B65H 19/1852 156/502
5,980,673 A * 11/1999 Takeuchi ..... A47K 10/16 156/183
6,059,928 A * 5/2000 Van Luu ..... D21F 11/14 162/111
7,517,433 B2 4/2009 Zwick et al.
8,142,613 B2 * 3/2012 Biagiotti ..... D21F 11/006 156/219
8,142,614 B2 * 3/2012 Biagiotti ..... D21F 11/006 156/219
2002/0028230 A1 * 3/2002 Eichhorn ..... A61K 8/0208 424/443
2002/0146561 A1 * 10/2002 Baumoller ..... D21F 11/14 428/375
2003/0001042 A1 * 1/2003 Betti ..... B65H 19/29 242/527
2003/0041989 A1 * 3/2003 Oriarian ..... B31F 1/07 162/184
2003/0075262 A1 * 4/2003 Hein ..... B31F 1/07 156/209
2004/0096604 A1 * 5/2004 van de Camp ..... B31C 1/00 428/34.2
2005/0153100 A1 * 7/2005 Zoller ..... B31F 1/07 428/131
2006/0217831 A1 * 9/2006 Butterworth ..... B65H 26/00 700/126
2006/0243405 A1 * 11/2006 Zwick ..... D21H 21/22 162/135
2006/0278357 A1 * 12/2006 Suzuki ..... B31F 1/07 162/117
2007/0095693 A1 * 5/2007 De Luca ..... B65B 9/045 206/389
2007/0295464 A1 * 12/2007 Fetner ..... A61K 8/0208 162/103
2008/0029235 A1 * 2/2008 Edwards ..... D21F 11/006 162/111
2008/0105776 A1 * 5/2008 Wojcik ..... B65H 19/30 242/366.3
2008/0207867 A1 * 8/2008 Uehara ..... A47K 10/16 528/271
2008/0283656 A1 11/2008 Gelli
2009/0101748 A1 * 4/2009 Maddaleni ..... B65H 18/28 242/541.2
2009/0297781 A1 * 12/2009 Huss ..... B31F 1/07 428/166
2010/0163194 A1 * 7/2010 Sauter ..... B31F 1/07 162/114
2010/0167889 A1 * 7/2010 Walgenwitz ..... A47K 10/16 492/53
2010/0272965 A1 * 10/2010 Schinkoreit ..... B31F 1/07 428/172
2011/0240789 A1 * 10/2011 Schoenberg ..... G01N 33/346 242/523.1
2012/0285615 A1 * 11/2012 Shiinoki ..... D21H 27/002 156/253

FOREIGN PATENT DOCUMENTS

JP H10-272710 A 10/1998
JP 11-323787 11/1999
JP 2006-007218 A 1/2006
JP 2007-015379 1/2007
JP 2008-245780 A 10/2008
JP 2009-183411 8/2009
JP 2010-173267 A 8/2010
JP 2010-188690 A 9/2010
WO 1995-35411 A1 12/1995
WO 2006-025362 A1 3/2006
WO 2007-116720 A1 10/2007

* cited by examiner

METHOD FOR MANUFACTURING TOILET ROLL PRODUCTS AND TOILET ROLL PRODUCTS

TECHNICAL FIELD

The present invention relates to toilet roll products each manufactured by packing toilet rolls, obtained by winding toilet paper applied with chemicals and having crepe, and a manufacturing method thereof.

BACKGROUND ART

Toilet paper is generally made in a form of a toilet roll in which continuous band-like paper is wound on a core called a paper core, and is available in the market as toilet roll products in which a plurality of these toilet rolls are packed.

In the toilet paper, users are interested in a price, a moisture-retaining property (wetness hand feel), flexibility (softness hand feel), and a surface lubrication property (smoothness hand feel), and request high-quality toilet paper in these respects.

Further, for a patient who suffers from a hemorrhoid disease or the like, it is difficult to rub the skin strongly with the paper in cleaning operation after excretion. For this reason, such a patient with a hemorrhoid disease is highly interested in toilet paper, which is improved in a wiping property, bulkiness, a moisture-retaining property, softness, and a surface lubrication property, so that he or she desires products satisfying these properties.

Further, the toilet paper is used not only after excretion, but also after urination for particularly a woman's cleaning operation. Here, since the woman's cleaning operation after urination is performed while the paper contacts a sensitive pubic region, there is a latent demand for toilet paper with a moisture-retaining property and softness.

Here, the toilet paper can be applied with chemicals which improve the characteristics such as a moisture-retaining property (wetness hand feel), flexibility (softness hand feel), and a surface lubrication property (smoothness hand feel).

However, the conventional toilet rolls applied with chemicals are expensive with low productivity. Further, the toilet roll is not sufficiently improved in all the characteristics and does not satisfy the user's demand.

For this reason, the conventional toilet roll products applied with chemicals have not been widely used.

Generally, in a conventional toilet roll, a paper roll manufactured by a paper manufacturing machine is conveyed to a winder and is rewound with the diameter of the toilet roll in the winder so as to manufacture a log having a width plural times or more a toilet roll width, and the log is cut into the toilet roll width so as to manufacture the toilet roll. In a case of manufacturing multi-ply products, continuous sheets reeled out from a plurality of paper rolls are multi-plied before the rewinding in the winder.

Then, a method for manufacturing the toilet roll applied with chemicals is disclosed in, for example, Patent Literatures 1 to 3 below.

In a technique of Patent Literature 1, steel-rubber embossing is performed when manufacturing a log from a paper roll set in a winder, chemicals are applied to embossing convex portions of a convex embossing roll, and the chemicals are transferred to a continuous sheet reeled out from the paper roll.

However, in the technique of Patent Literature 1, since the chemicals are applied only by the tips of the embossing convex portions to the continuous sheet, the amount of applied chemicals is small. Further, there is a concern that the chemicals may not be applied to an embossing concave surface. For this reason, it is difficult to sufficiently improve the surface lubrication property and the moisture-retaining property. Further, since chemicals applying process in which the paper strength is the lowest, and the embossing process, in which the continuous sheet are nipped with a predetermined pressure, are performed at the same time, paper breakage may be easily occurred and hence these processes need to be performed at a low speed. For this reason, it is difficult to improve the productivity.

Meanwhile, in a technique of Patent Literature 2, embossing is performed when manufacturing a log from a paper roll set in a winder and chemicals are applied in spraying.

However, even in the technique of Patent Literature 2, since the log is manufactured immediately after applying the chemicals, the chemicals tend to spread in the sheet after manufacturing the log, and hence there is a disadvantage that the log tends to loose the shape and deviate in winding due to stretching of the sheet caused by stretching of crepe. Particularly, since the log is cut, at a post stage, into a toilet roll, once the log deviates in winding or looses the shape, which causes defective toilet roll products, this means the yield is degraded, leading to low productivity.

Further, as in Patent Literature 1, since the log is manufactured immediately after the chemicals application applying process, the tension control is difficult, paper breakage may be easily occurred on forming perforation lines on the sheet and the tension of the continuous sheet is decreased, thereby the processing speed needs to be decreased. Accordingly, the productivity cannot be improved.

Further, in the technique of Patent Literature 2, since the chemicals are applied particularly by spray application after the embossing, the embossing may easily loose shape thereof. Furthermore, the amount of the ejected chemicals is limited because of the spraying in the winder, so, if the operation would not be performed at a low speed, the amount of applied chemicals to the continuous sheet would be insufficient, which leads inevitably to low productivity.

In a technique of Patent Literature 3, embossed crepe paper is obtained as base paper for toilet paper products. Here, continuous sheets are reeled out from a plurality of paper rolls; multi-ply forming is performed on continuous sheets, chemicals are applied to these multi-ply continuous sheets, water is further sprayed thereto so that the sheets become wet sheets, and embossing is performed on the sheets. Then, the respective multi-ply continuous sheets are separated before the rewinding.

However, in the technique of Patent Literature 3, since water is sprayed before the embossing, the embossing is performed before the continuous sheet is sufficiently impregnated with the chemicals or the water. For this reason, the chemicals, which are not impregnated yet into the surface of the continuous sheet, tend to adhere to a convex embossing roll and a receiving roll used for the embossing. Since this condition may cause the tearing of the sheet and stop of the manufacturing line for a cleaning operation, the productivity cannot be improved.

It is known that if oily chemicals are used for application, decrease of paper strength can be suppressed, and a toilet roll, which uses such oily chemicals, is also known. In such a toilet roll, the surface lubrication property can be sufficiently improved, but the moisture-retaining property is not sufficient. This is because, the oily chemicals are, among chemicals, known to unlikely to be impregnated into sheet layers. Further, for the toilet roll which uses oily chemicals, it is difficult to obtain the water disintegration property necessary for the toilet roll.

CITATION LIST

Patent Literature

Patent Literature 1: JP 11-323787 A
Patent Literature 2: JP 2009-183411 A
Patent Literature 3: JP 2007-15379 A

SUMMARY OF INVENTION

Technical Problem

Therefore, it is a main object of the present invention to provide a method for manufacturing toilet roll products that sufficiently improve a moisture-retaining property (wetness hand feel), flexibility (softness hand feel), and a surface lubrication property (smoothness hand feel) while sufficiently ensuring a performance such as a water disintegration property necessary for toilet paper and that is manufactured with good productivity. Further, it is an object of the present invention to provide a method for manufacturing toilet roll products capable of improving the above functions such as productivity, moisture-retaining property, as well as design characteristic by embossing, and bulkiness.

Solution to Problem

The means for solving the problem and the operation and the effect thereof are illustrated as below.

[Invention of Claim 1]

A method for manufacturing toilet roll products applied with chemicals; comprising:

continuously manufacturing a secondary paper roll for the toilet roll products, by using purposely a ply machine, from a primary paper roll, which has been manufactured and wound by a paper manufacturing machine, wherein the ply machine includes a multi-ply forming unit, which performs multi-ply forming on single-sheets from the primary paper rolls, reeled out of a plurality of the primary paper rolls along the continuation direction so as to form a multi-ply continuous sheet, a chemicals applying unit, which is provided at a post stage of the multi-ply forming unit so as to apply the chemicals to the multi-ply continuous sheet, and a winding unit, which winds the multi-ply continuous sheet applied with the chemicals so as to form the secondary paper roll having a width plural times or more a width of a toilet roll;

setting the secondary paper roll for the toilet paper products, which has been manufactured by the ply machine and applied with the chemicals, in a paper roll support portion of a winder; reeling out a multi-ply-sheet from the secondary paper roll, which has been applied with the chemicals, in the winder; forming perforation lines on the multi-ply-sheet from the secondary paper roll in the width direction of the multi-ply-sheet from the secondary paper roll at a predetermined interval in the flow direction; and after that, rewinding the multi-ply-sheet from the secondary paper roll, which has been provided with the perforation lines with a winding diameter of a toilet roll, so as to manufacture a log for the toilet roll;

conveying the log manufactured in the winder to a log cutter; cutting the log into the width of the toilet roll by the log cutter so as to become individual toilet rolls; and putting one or plural toilet rolls in a product packing bag in a packing facility so as to obtain the toilet roll products.

[Invention of Claim 2]

The method for manufacturing the toilet roll products applied with the chemicals according to claim 1, wherein the ply machine includes an embossing unit, and performs single embossing on the multi-ply continuous sheet after or before application of the chemicals, in the embossing unit.

[Invention of Claim 3]

The method for manufacturing the toilet roll products applied with the chemicals according to claim 1, wherein the ply machine includes an embossing unit which is provided at a previous stage of the multi-ply forming unit, embosses the respective single-sheets from the primary paper rolls in the embossing unit, and after that, performs multi-ply forming on the respective single-sheets from the primary paper rolls, which have been embossed, in the multi-ply forming unit.

[Invention of Claim 4]

The method for manufacturing the toilet roll products applied with the chemicals according to claim 1, wherein the ply machine includes a multi-ply forming unit, a ply-separating unit, an embossing unit, and a re-multi-ply forming unit in this order, temporarily performs multi-ply forming on the respective single-sheets from the primary paper rolls in the multi-ply forming unit, after that, ply-separates the multi-ply continuous sheet into the respective continuous sheets in the ply-separating unit, and embosses the continuous sheets, which have been ply-separated, in the embossing unit.

[Invention of Claim 5]

The method for manufacturing the toilet roll products applied with the chemicals according to claim 1, wherein the winder includes an embossing unit, and performs single embossing on the multi-ply-sheet from the secondary paper roll, which has been reeled out from the secondary paper roll and applied with the chemicals, in a multi-ply state, in the embossing unit.

[Invention of Claim 6]

The method for manufacturing the toilet roll products applied with the chemicals according to claim 1, wherein the ply machine includes a slitting unit between the chemicals applying unit and the winding unit, slits the secondary paper roll applied with the chemicals into a width plural times or more the width of the toilet roll, in the slitting unit, and after that, winds by the same shaft the multi-ply continuous sheets, which have been cut into the width plural times or more the width of the toilet roll, in the winding unit.

[Invention of Claim 7]

The method for manufacturing the toilet roll products applied with the chemicals according to claim 1, wherein the ply machine includes a ply bonding unit, which is provided at a post stage of the multi-ply forming unit, and performs linear ply bonding on the multi-ply continuous sheet so as to prevent ply-separating, and performs ply bonding correspondingly to the width of the toilet roll in the ply boding unit.

[Invention of Claim 8]

The method for manufacturing the toilet roll products applied with chemicals according to claim 1, wherein the winder includes an embossing unit, which is provided at a previous stage of a perforation line applying unit, and performs single embossing on the multi-ply-sheet from the secondary paper roll, which is reeled out from the secondary paper roll and is applied with the chemicals, in a multi-ply state, in the embossing unit.

[Invention of Claim 9]

The method for manufacturing toilet roll products applied with chemicals according to claim 1, wherein the winder includes a ply-separating unit, an embossing unit, and a re-multi-ply forming unit, which are provided in this order at a previous stage of a perforation line applying unit, ply-separates the multi-ply-sheet from the secondary paper roll, which is reeled out from the secondary paper roll and is applied with the chemicals, into the respective continuous sheets in the ply-separating unit, after that, embosses the ply-separated continuous sheets in the embossing unit, and performs re-multi-ply forming on the continuous sheets in the re-multi-ply-forming unit.

[Invention of Claim 10]

The method for manufacturing the toilet roll products applied with the chemicals according to claim 4, wherein the ply machine includes a ply bonding unit which is provided at a post stage of the re-multi-ply forming unit and performs linear ply bonding on the multi-ply continuous sheet so as to prevent ply-separating, and performs ply bonding correspondingly to the width of the toilet roll in the ply boding unit.

[Invention of Claim 11]

A method for manufacturing the toilet roll products applied with the chemicals, comprising:

continuously manufacturing a secondary paper roll for the toilet roll products by using purposely a ply machine from a primary paper roll, which has been manufactured and wound by a paper manufacturing machine, wherein, the ply machine to be used is configured by assembling, in the sheet flow direction, a multi-ply forming unit, which performs multi-ply forming on continuous sheets reeled out of a plurality of the primary paper rolls along the continuation direction so as to form a multi-ply continuous sheet, a chemicals applying unit, which is provided at a post stage of the multi-ply forming unit so as to apply the chemicals to the continuous sheet, and a winding unit, which winds the continuous sheet applied with the chemicals so as to form the secondary paper roll having a width plural times or more a width of a toilet roll;

winding a single continuous sheet applied with the chemicals by using one primary paper roll without operating the multi-ply forming unit in the ply machine so as to manufacture the secondary paper roll made of a non-multi-ply continuous sheet;

setting the secondary paper roll for the toilet roll products, which has been manufactured by the ply machine and applied with the chemicals in the ply machine, in a paper roll support portion of a winder; reeling out a multi-ply-sheet from the secondary paper roll applied with the chemicals from the secondary paper roll in the winder; forming perforation lines on the multi-ply-sheet from the secondary paper roll in the width direction of the multi-ply-sheet from the secondary paper roll at a predetermined interval in the flow direction; and after that rewinding the multi-ply-sheet from the secondary paper roll provided with the perforation lines with a winding diameter of a toilet roll so as to manufacture a log for the toilet roll;

conveying the log manufactured in the winder, to a log cutter; cutting the log into the width of the toilet roll by the log cutter into individual toilet rolls, and putting one or plural toilet rolls in a product packing bag in a packing facility so as to obtain the toilet roll products.

[Invention of Claim 12]

The method for manufacturing the toilet roll products applied with the chemicals according to claim 11, wherein the ply machine includes an embossing unit, which is provided at a post stage of the chemicals applying unit, and performs single embossing on the single-sheet from the primary paper roll applied with the chemicals in the chemicals applying unit.

[Invention of Claim 13]

The method for manufacturing the toilet roll products applied with the chemicals according to claim 11, wherein the winder includes an embossing unit and a multi-ply forming unit, which are provided in this order at a previous stage of a perforation line applying unit, sets a plurality of secondary paper rolls in the winder, embosses the respective continuous sheets reeled out from the respective secondary paper rolls in the embossing unit, and after that performs multi-ply forming in the multi-ply forming unit.

[Invention of Claim 14]

The method for manufacturing the toilet roll products applied with the chemicals according to claim 11, wherein the winder includes a multi-ply forming unit and an embossing unit, which are provided in this order at a previous stage of a perforation line applying unit, sets a plurality of secondary paper rolls in the winder, performs multi-ply forming on the respective continuous sheets reeled out from the respective secondary paper rolls in the multi-ply forming unit, and after that performs a single embossing on the multi-ply continuous sheet, on which multi-ply forming has been performed, in the embossing unit.

[Invention of Claim 15]

The method for manufacturing the toilet roll products applied with the chemicals according to claim 1 or 11, wherein the chemicals applying unit in the ply machine is of flexographic printing.

[Invention of Claim 16]

The method for manufacturing the toilet roll products applied with the chemicals according to claim 15, wherein the multi-ply continuous sheet is conveyed at a speed of 500 m/minute or higher when the chemicals are applied in the flexographic printing.

[Invention of Claim 17]

Toilet roll products, which are manufactured by the manufacturing method according to any one of claims 1 to 16.

Advantageous Effects of Invention

In the present invention, a continuous sheet is applied with chemicals in a ply machine and is wound once to manufacture a secondary paper roll, and then a log is manufactured in a winder.

A ply machine is often used to manufacture two-ply (two-layer) or multi-ply tissue paper.

However, on manufacturing toilet rolls, even if they are two-ply products, it is normal that a log is manufactured while multi-ply forming is performed in a winder and it is unusual that a winding process is performed purposely and separately for example in a ply machine.

In contrast, in the present invention, such a ply machine is used purposely, precisely, it is designed that the secondary paper roll to be supplied to the winder is continuously manufactured from a primary paper roll obtained by manufacturing and winding a paper sheet in the ply machine and a chemicals applying unit is provided inside the ply machine so as to apply chemicals to the continuous sheet for manufacturing the secondary paper roll applied with the chemicals.

Accordingly, first, as a first advantage attained by using the ply machine, in a manufacturing factory equipped with a toilet roll manufacturing facility and a tissue paper product facility, a part of a toilet roll manufacturing line and a general tissue paper manufacturing line can be commonly used. In this case, there is advantageously no need to provide another chemicals applying unit for the toilet roll. Accordingly, the above advantage enables space-saving with low facility investment.

Further, even when an existing ply machine is not provided with a chemicals applying unit, only minor modification of the existing ply machine is required instead of the great modification, resulting in another advantage of less facility investment.

Meanwhile, in a case where toilet roll products applied with chemicals are manufactured through manufacturing of a secondary paper roll applied with the chemicals in a ply machine, since the secondary paper roll is obtained by winding the multi-ply continuous sheets applied with the chemicals like annual growth rings, the chemicals diffuse with time into inner layers of the multi-ply-sheet from the secondary paper roll and between the multi-ply continuous sheets contacting mutually in the state of the secondary paper roll. Further, it is possible to ensure transfer period to processing treatment in the winder or intentional seasoning time, leading to the uniform diffusion of chemicals inside the multi-ply continuous sheet.

Thus, in the winder, on forming of a perforation line, although which originally degrades paper strength but is necessary for the toilet roll, there is little difference part to part in the continuous sheet, which enables stable operation and improved manufacturing speed in the winder.

However, particularly when water-based chemicals are used, the chemicals diffuse in sheets. In this case, paper strength is degraded and uniform diffusion of the chemicals cannot be attained shortly.

Further, since the diffusion of the chemicals, the moisture absorbing to the sheet, and the growth of the crepe of the sheet are sufficiently performed at the secondary paper roll, for the log manufactured by winging with the winder, it is unlikely to cause an adverse effect such as deviating in winding, loosing shape and the like, which would be caused by the diffusion of the chemicals, the moisture absorbing to the sheet, and the growth of the crepe of the sheet. For this reason, even when the log is manufactured by winding the toilet paper having a comparatively short length so as to have a predetermined diameter in a form of a so-called loosely wound manner, it is unlikely to cause deviating in winding, loosing shape resulting in stable operation with low incidence of defective log.

Meanwhile, in the present invention, it is possible to manufacture the embossed toilet roll. Such embossing can be performed by the ply machine or by the winder.

In a case of forming of the embossing by the ply machine, the embossing may be rapidly and stably performed without a perforation line applying unit. In a case of forming of the embossing by the winder, the embossing may be performed while the chemicals are uniformly diffused. In either case, it is possible to further rapidly and stably perform the embossing in the toilet roll applied with the chemicals than ever before.

Particularly, in a case of performing of the embossing by the ply machine, since the embossing is performed on the multi-ply continuous sheet with a relatively strong tensile strength, it is advantageous in that the ply machine may be operated at a high speed. Further, even in a case of double embossing, if one surface is applied with the chemicals, it is possible to reduce degradation in the paper strength, which would be caused by the application of the chemicals, and high speed of embossing can be sufficiently attained. In the manner where such double embossing is performed, it is possible to manufacture the multi-ply continuous sheet which is thick and bulky, resulting in advantageous texture.

Meanwhile, in a case of performing of the embossing by the winder, since the secondary paper roll applied with the chemicals is used, it is possible to perform the embossing while the chemicals are uniformly diffused inside the sheet. Then, it is possible to reliably perform the embossing without any unevenness and to ensure the stable production with a high speed.

Meanwhile, in the present invention, a single-ply secondary paper roll may be manufactured without operating the multi-ply forming unit in the ply machine. Then, the log may be manufactured by performing multi-ply forming on a plurality of the secondary paper rolls in the winder. Alternatively, the log may be manufactured in the winder in a non-multi-ply state. Even in these cases, it is advantageous in that the secondary paper roll can be rapidly manufactured in the ply machine. Further, in a case of performing the embossing in the winder, since the secondary paper roll applied with the chemicals is used, it is possible to perform the embossing while the chemicals are uniformly diffused into the sheet and to reliably perform the embossing without any unevenness. That is, the products can be manufactured stably and at a high speed.

BRIEF DESCRIPTION OF DRAWINGS

FIG. 20(A) illustrates a structure with two inlets and one outlet, FIG. 20(B) illustrates a structure with three inlets and two outlets, and FIG. 20(C) illustrates a structure with the same number of inlets and outlets;

DESCRIPTION OF EMBODIMENTS

Figure 1:
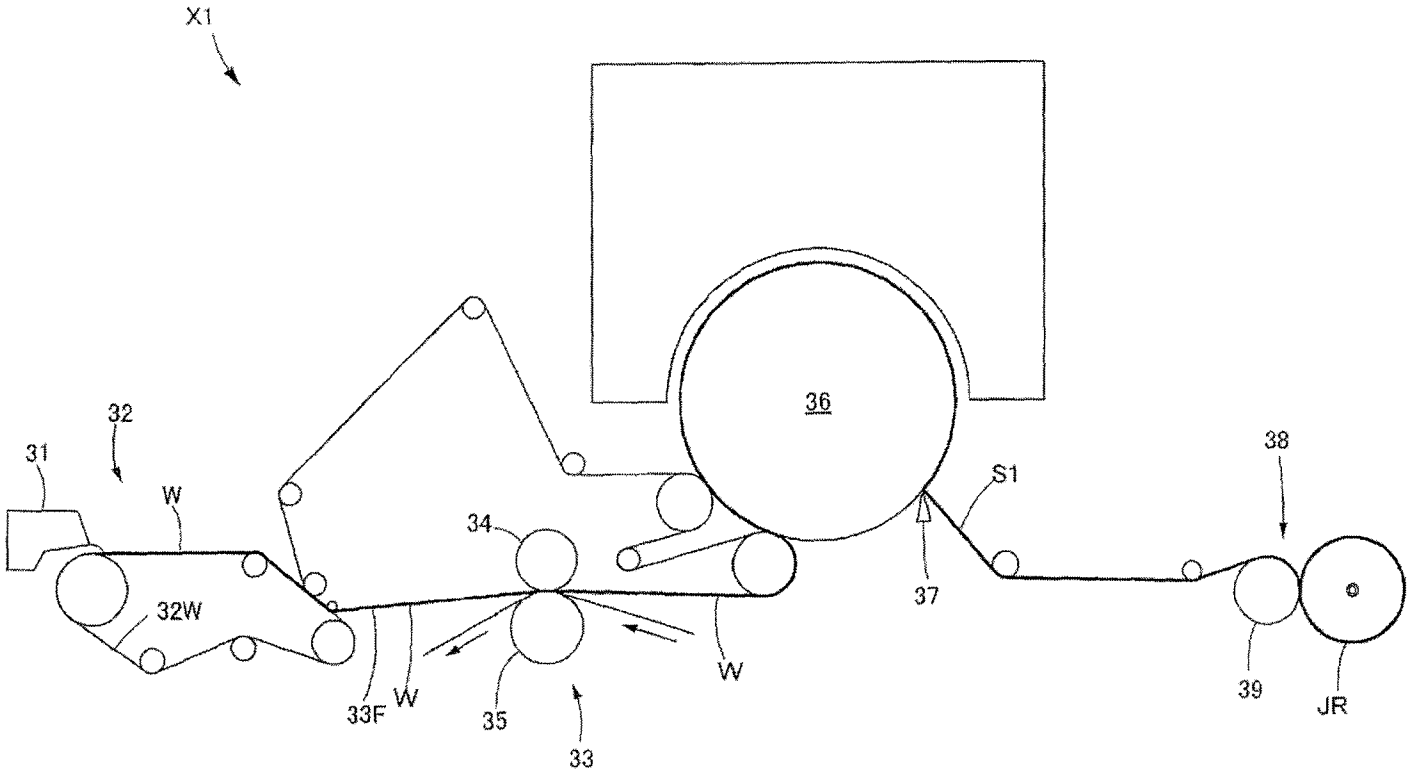
FIG. 1 is a schematic diagram illustrating a method for manufacturing a primary paper roll in a paper manufacturing machine.

Hereinafter, embodiments of the present invention will be described in detail by referring to the drawings. In the drawings, the arrow HD indicates the horizontal direction and the arrow LD indicates the vertical direction. Furthermore, the present invention is not limited to the embodiments.

"First Embodiment; Embossing is not Performed"

[Paper-Manufacturing Process: Method and Facility for Manufacturing Primary Paper Roll]

A primary paper roll JR (referred to as a jumbo roll) according to the present invention may be manufactured as below by an exemplary paper manufacturing machine X1 illustrated in FIG. 1.

First, a paper material, which has been adjusted in advance by adding appropriate chemicals from a head box 31 to pulp slurry, is supplied onto a wire 32*w* of a wire part 32 so as to form wet paper W (forming process). Then, the wet paper W is conveyed to a felt 33F of a press part 33 and is dewatered by being nipped between a pair of dewatering rolls 34 and 35 (dewatering process).

Subsequently, the dewatered wet paper W is attached to a surface of a Yankee dryer 36 so as to be dried. Then, the dried paper was separated therefrom with a doctor blade 37 so as to be dry base paper S1 (single-sheet from the primary paper roll as described later) with crepe (drying process).

Then, the dry base paper S1 is wound by a winding unit 38 with a winding drum 39 so that the rear surface of the dry base paper S1 faces the shaft of the primary paper roll JR (the rear surface thereof becomes the inner winding surface) and becomes the primary paper roll JR (primary paper winding process).

The primary paper roll JR has the diameter of substantially 1000 to 5000 mm, the length (width) of 1500 to 9200 mm, and the winding length of 5000 to 80000 m, although they may change depending on performance of paper manufacturing machine X1.

Furthermore, a calendering step (not illustrated) may be provided, for the dry base paper S1, which has been separated by the doctor blade 37 provided at a previous stage of the primary paper winding process, so that the front and rear surfaces are smoothened.

Here, the rear surface of the dry base paper S1 indicates a surface opposite to a surface contacting a cylinder of the Yankee dryer 36. Furthermore, although depending on the existence or non-existence of the calendering process, it can be considered that the front surface contacting the Yankee dryer that generally has a mirror surface is smoother with better surface property.

Here, the single-sheet S1 from the primary paper roll which defines the primary paper roll JR is to be processed into toilet paper 1 later, and the basis weight thereof is substantially equal to the basis weight of the toilet paper as final products. Specifically, by taking this into consideration, a basis weight of the single-sheet S1 from the primary paper roll is 10 to 25 g/m$^2$, desirably 12 to 20 g/m$^2$, more desirably 13 to 18 g/m$^2$ according to JIS P 8124. A basis weight less than 10 g/m$^2$ is preferable from the viewpoint of improving the paper in softness but makes it difficult to provide a sufficient strength properly for practical use and to perform the rewinding (log manufacturing) in the winder provided at a post stage. Meanwhile, a basis weight of more than 25 g/m$^2$ makes the toilet paper too hard with deteriorated hand feel.

Further, the paper thickness (measured by a dial thickness gauge manufactured by Ozaki. Co., Ltd) is 80 to 250 μm, desirably 100 to 200 μm, and more desirably 130 to 180 μm.

Further, the crepe ratio of the single-sheet S1 from the primary paper roll is 10 to 30%, desirably 15 to 28%, and more desirably 20 to 25%. A crepe ratio of smaller than 10% causes easily paper breakage in processing treatment provided at a post stage, and the resultant toilet paper does not stretch sufficiently with small rigidity. Meanwhile, a crepe ratio of more than 30% makes it difficult to control tension in the processing treatment and causes easily paper breakage and makes the manufactured toilet paper deteriorate in an appearance due to formed wrinkles.

Here, the crepe ratio is expressed by the following equation.

Crepe ratio: {(peripheral speed of a dryer at paper manufacturing)−(peripheral speed of a reel in a winding unit)}/(peripheral speed of the dryer at paper manufacturing)×100

Further, the dry tensile strength (hereinafter, referred to as also a dry paper strength) of the single-sheet S1 from the primary paper roll in the longitudinal direction specified by JIS P 8113 is set to 300 to 900 cN/25 mm, desirably 350 to 800 cN/25 mm, and particularly desirably 400 to 700 cN/25 mm in a case of two plies. Meanwhile, the dry tensile strength in the transverse direction is set to 100 to 400 cN/25 mm, desirably 130 to 350 cN/25 mm, and particularly desirably 150 to 300 cN/25 mm in a case of two plies. Too low dry tensile strength of the base causes easily trouble such as paper breakage, stretching and the like at paper manufacturing and during use. Meanwhile, too high dry tensile strength deteriorates paper hand feel represented by softness hand feel.

The paper strength can be adjusted as appropriate by known methods for example, by adding a dry paper strength enhancer to paper materials or wet paper; by decreasing freeness of paper materials (for example, to 30 to 40 ml or so); by increasing combination ratio of NBKP in raw material pulp (for example, to 50% or more); and by appropriately combining the above manners.

Furthermore, as the dry paper strength enhancer, starch, polyacrylamide, CMC (carboxymethylcellulose) and as salts thereof, carboxymethylcellulose sodium, carboxymethylcellulose calcium, carboxymethylcellulose zinc, or the like may be used. As the wet paper strength enhancer, polyamide-polyamine-epichlorohydrin resin, urea resin, melamine resin acid colloid, thermal cross-linking polyacrylamide agent and the like may be used.

In a case of adding the dry paper strength enhancer, an amount of addition may be set to about 0.5 to 1.0 kg/t as the weight ratio with respect to pulp slurry.

Since the toilet paper needs to be disintegrated in water, it is desirable that the wet paper strength agent be not added or be added by a small amount. However, in a case of adding the wet paper strength agent, this agent conducts an advantageous action in manufacturing the log in the winder provided at the post stage. In consideration of this advantageous point, the agent may be added by a small amount, that is, 5 kg/t or less as the weight ratio with respect to the pulp slurry.

A paper material, which becomes a raw material of the primary paper roll (the primary paper sheet), will be explained below. The paper material is obtained by adding appropriate chemicals to slurry (pulp slurry) mainly having pulp as a fiber raw material.

In the present invention, the raw material pulp is not particularly limited, and appropriate raw material pulp used for the toilet paper may be selected for use.

It is preferable that raw material pulp is a combination of NBKP and LBKP. It is possible to blend recycled pulp, however, a mixture of only NBKP and LBKP of virgin pulp is preferable in terms of the favorable compatibility with lotion chemicals in accordance with the present invention, appropriate manufacturing of the log in the winder and desirable hand feel of the resultant tissue paper. In this case, the mixture ratio (JIS P 8120) is NBKP:LBKP=20:80 to 80:20, in particular desirably NBKP:LBKP=30:70 to 60:40.

As the chemicals added to the paper material, there are a peeling agent, an adhesive agent, a pH adjuster such as caustic soda, a mucilaginous agent, an antifoaming agent, an antiseptic agent, a slime control agent, a dying agent, and the like may be exemplified other than the above dry paper strength agent and the wet paper strength agent. Furthermore, these chemicals may be applied onto the wet paper by an appropriate process.

[Process in Ply Machine: Method and Facility for Manufacturing Secondary Paper Roll]

Figure 2:
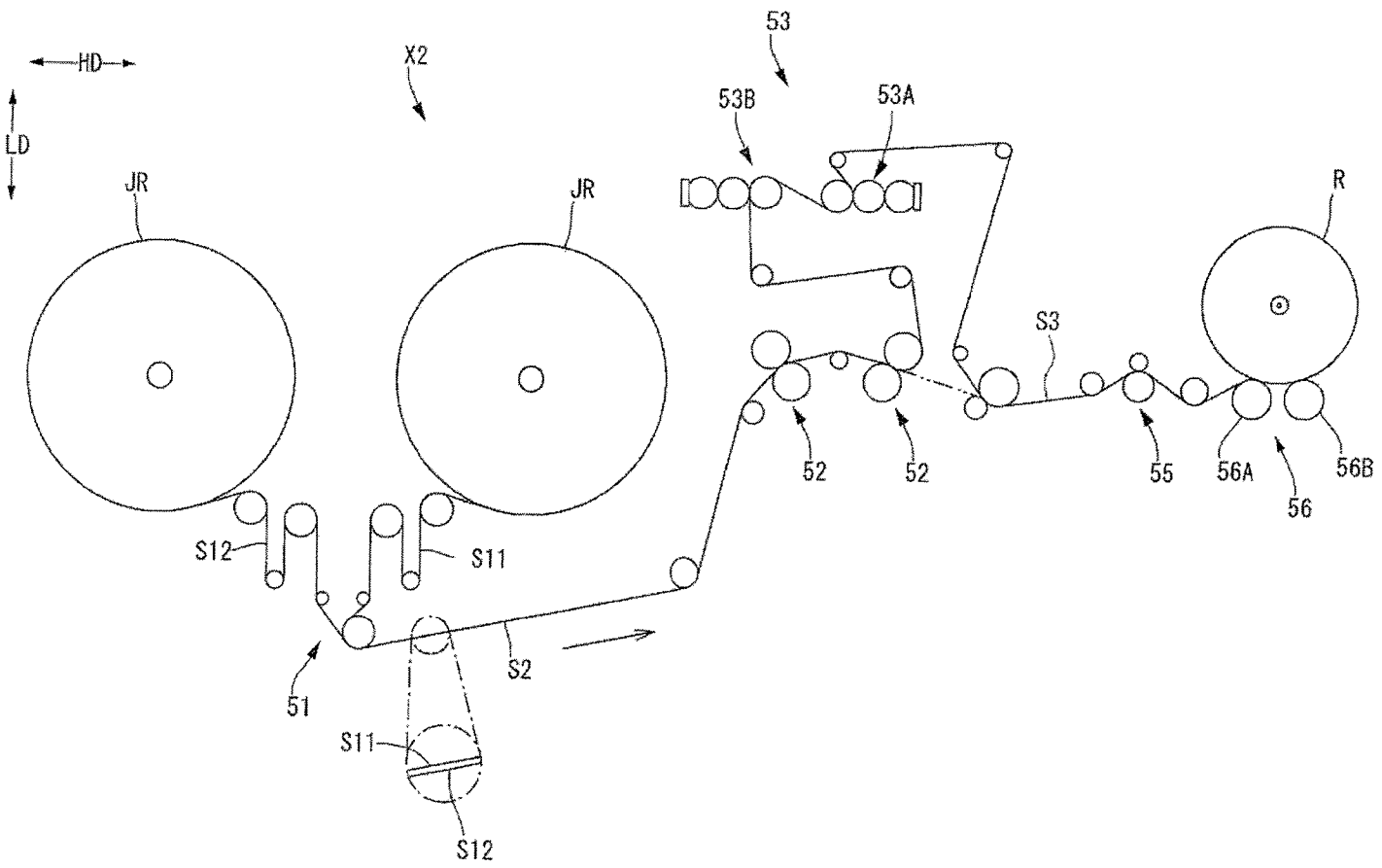
FIG. 2 is a schematic diagram illustrating an example of a method for manufacturing a secondary paper roll in a ply machine according to the first embodiment.

In the present invention, a secondary paper roll R applied with the chemicals is manufactured from the primary paper roll JR, which has been manufactured by the paper manufacturing machine X1, purposely in a ply machine X2 illustrated in FIG. 2.

The ply machine X2 according to the embodiment may set two or more primary paper rolls JR thereto, single-sheets (S11 and S12 in the example illustrated in the drawing) from the primary paper rolls which are reeled out of the respective primary paper rolls JR and JR are multi-plied along the continuation direction and are supplied to a multi-ply forming unit 51 so as to become a multi-ply continuous sheet S2. Here, the multi-ply forming unit 51 includes a pair of nipping rolls and performs multi-ply forming on and nips the respective single-sheets S11, S12 from the primary paper rolls so that the respective single-sheets from the primary paper rolls are multi-plied and integrated.

Furthermore, in the example illustrated in the drawing, the single-sheets S11 and S12 from the primary paper rolls reeled out of the respective primary paper rolls JR and JR are supplied to the multi-ply forming unit 51 so that the surfaces thereof become the surfaces of the multi-ply continuous sheet S2 (here, the "surfaces" of the multi-ply continuous sheet indicate the front and rear surfaces of the multi-ply continuous sheet S2 as the outer surfaces thereof). The rear surfaces of the single-sheets S11 and S12 from the primary paper rolls may respectively become the surfaces of the multi-ply continuous sheet S2. Then, any one of the rear surfaces of the single-sheets S11 and S12 from the primary paper rolls may become the surface of the multi-ply continuous sheet S2, and the other rear surface thereof may become the surface of the multi-ply continuous sheet S2. However, since the front surfaces of the primary paper sheets S11 and S12 contact the surface of the Yankee dryer during the drying process, the front surfaces are less fuzzy, smoother and better sensation of touch than the rear surfaces. For this reason, it is desirable to define the front and rear surfaces of the multi-ply continuous sheet S2 by the front surfaces of the single-sheets from the primary paper rolls (the dry base papers S1).

Further, in the example illustrated in the drawing, two primary paper rolls JR are set and a so-called two-ply continuous sheet is wound. However, a three-ply or a four-ply continuous sheet may be wound by setting three or four primary paper rolls.

In the first embodiment, a chemicals applying unit 53 is provided at a post stage of the multi-ply forming unit 51 of the ply machine X2, and a chemicals applying process for continuously applying chemicals to the multi-ply continuous sheet S2 is performed. Furthermore, a configuration may be employed in which the front and rear installation positions of the multi-ply forming unit 51 and the chemicals applying unit 53 are switched, the chemicals are applied to the respective single-sheets S11 and S12 from the primary paper rolls, and after that, the single-sheets from the primary paper rolls applied with the chemicals are multi-plied on each other.

In order to apply the chemicals onto the multi-ply continuous sheet S2 in the ply machine X2, the chemicals applying unit 53 may employ flexographic printing, spray application, inkjet printing, or the like. However, the flexographic printing is suitable, because in flexographic printing, high-speed performance of the ply machine X2 can be handled, a printing plate cylinder is flexible, high-speed operation can be ensured, scattering of the chemicals can be prevented, and amount of applied material can be adjusted. Further, the spray application, the inkjet printing, and curtain coating as non-contact application where the chemicals are applied directly onto the paper surface without using a printing plate cylinder or the like are desirable in that paper thickness is not decreased since the printing plate cylinder or the like does not contact the paper surface. However, in the non-contact application, uniform application and adjustment of an amount of applied chemicals may not be performed rapidly compared to roll transfer type applying unit such as flexographic printing. Further, in an embodiment where embossing is performed, as discussed later, such disadvantage becomes noticeable. Accordingly, in the present invention, the roll transfer type is desirable, and the flexographic printing is the most desirable from the general viewpoint.

The number of the chemicals applying unit 53 may be either one or plural. In the example illustrated in the drawing, the embodiment is shown where two doctor chamber type flexographic printers 53A and 53B are provided so as to apply the chemicals to both outer surfaces of the multi-ply continuous sheet S2. In a case where a plurality of chemicals applying unit 53 are provided, the plurality of chemicals applying unit may be provided in parallel in the horizontal direction, the vertical direction, or the inclination direction or may be provided by combining these installation directions including the horizontal direction. When the plurality of chemicals applying unit are provided in parallel in the horizontal direction, the embracing angle can be set to be small, and hence the processing speed can be increased. When the plurality of chemicals applying unit are provided in parallel in the vertical direction, the installation space in the horizontal direction may be set to be small.

Regarding an amount of applied chemicals, the total amount on both the outer surfaces (the respective surfaces that become the outer surfaces of the toilet paper) is set to 0.3 to 5.0 g/m$^2$, desirably 1.0 to 3.9 g/m$^2$, and more desirably 2.0 to 3.0 g/m$^2$. The amount of more than 3.9 g/m$^2$ may cause paper breakage due to decreased paper strength or stretching, and cause also too strong stickiness hand feel in quality, and additionally, such amount makes it difficult to rewind (log manufacturing) as described later. Meanwhile the amount of less than 0.3 g/m$^2$ make it difficult to feel any difference in smoothness or wetness hand feel in quality from those of non-applied products. An amount of applied chemicals is more preferably 2.0 to 3.0 g/m$^2$, which brings about high sensory evaluation in the thickness hand feel, the wetness hand feel and the like. Furthermore, in the present invention, an amount of applied chemicals to portions to be the outer surfaces of the toilet paper may be different from each other. Further, the chemicals may be applied to only one surface of the respective surfaces corresponding to the outer surfaces of the toilet paper.

As for the chemicals applied in the chemicals applying process, the viscosity is desirably 1 to 700 mPa·s at 40° C. More desirably, the viscosity is 50 to 400 mPa·s (40° C.). Particularly, a viscosity of smaller than 1 mPa·s is likely to cause scattered chemicals. On the contrary, a viscosity of larger than 700 mPa·s makes it difficult to control the amount of applied chemicals so as to be stable.

The chemicals used in the present invention are water based lotion chemicals, which include water and polyol as the components thereof. Particularly, it is desirable to include polyol of 70 to 90% and water of 1 to 15%. It is more desirable to include further functional chemicals of 0.01 to 22%.

As the above polyol, there are polyalcohol such as glycerin, diglycerin, propylene glycol, 1, 3-butylene glycol, polyethyleneglycol, and the derivative thereof and saccharides such as sorbitol, glucose, xylitol, maltose, maltitol, mannitol, and trehalose.

Among the elements, it is desirable to include, as a main component, polyalcohol such as glycerin and propyleneglycol in order to attain high sensory evaluation of softness, moisture-retaining property and the like as well as stability in viscosity and in an amount of the applied chemicals.

As the functional chemicals, there are softening agent, surfactant, inorganic and organic fine powders, an oily component, and the like. The softening agent and surfactant are effective to soften tissue or smoothen the surface thereof, and anionic surfactants, cationic surfactants and amphoteric surfactants are employed. The inorganic and organic fine powders cause the surface to be smooth. The oily component may improve a lubrication property, and higher alcohols such as; liquid paraffin, cetanol, stearyl alcohol, and oleyl alcohol may be employed.

Further, as the functional chemicals, a moisturizing agent may be any combination of one or more of hydrophilic high molecular gelatinizing agent, collagen, hydrolyzed collagen, hydrolyzed keratin, hydrolyzed silk, hyaluronic acid or salt thereof, ceramide, and the like may be added as chemicals which helps or maintains the moisture-retaining property of polyol.

Further, as the functional chemicals, an emollient agent such as various natural essences, vitamins, an emulsifying agent which stabilizes mixed components, an antifoaming agent which stabilizes the chemicals applying by suppressing foaming of the chemicals, an antimold agent, and a deodorant agent such as organic acid may be appropriately mixed. Further, an antioxidant agent of vitamin C and vitamin E may be contained.

The chemicals are applied at a temperature of 30° C. to 60° C. and desirably 35° C. to 55° C.

Here, there are generally various kinds of chemicals used for a type of products applied with chemicals, and the chemicals are largely classified into water based chemicals which contain water and polyol according to the present invention and oily chemicals which mainly contain water insoluble wax in a half-solid state at a room temperature. The water-based chemicals are characterized in easy handling, low price, and almost no decrease in water disintegrability.

Further, when the water-based chemicals are applied onto the sheet, the sheet is impregnated therewith along the sheet thickness direction (referred to also as the Z direction) due to excellent compatibility between the chemicals and pulp fiber forming the sheet, so that the properties of the entire sheet and the surface thereof are reformed. On the contrary, when the oily chemicals are applied onto the sheet, the oily chemicals mainly affect so as to improve smoothness of the surface with deteriorated water disintegrability. Meanwhile, the water-based chemicals are impregnated into the sheet so that crepe of the applied sheet is affected so as to stretch with decreased paper strength, but such affection is little in the case of the oily chemicals.

In the present invention, manufacturing can be carried out at a high speed although sufficient amount of such water-based chemicals are used with improvement of a moisture-retaining property (wetness hand feel), flexibility (softness hand feel), and a surface lubrication property (smoothness hand feel) and also with improved productivity.

The multi-ply continuous sheet S3, which is applied with the chemicals in the chemicals applying unit 53, is guided to a winding unit 56 so as to be wound thereon and becomes a secondary paper roll R. The winding unit 56 includes a pair of winding drums 56A and 56B which rotate so as to contact with the outer surface of the multi-ply continuous sheet S3 wound on a rotatable pipe shaft, and when these two winding drums 56A and 56A and the pipe shaft appropriately rotate, the multi-ply continuous sheet S3 applied with the chemicals is wound while being guided.

Here, the secondary paper roll R is a roll with an extremely large diameter compared to the winding diameter (diameter) of the toilet roll, and is different from a so-called log which has substantially the same diameter as the winding diameter of the toilet roll.

The present invention is characterized in that the log is not directly manufactured from the primary paper roll JR so that, by employing the ply machine X2, the secondary paper roll R applied with the chemicals is manufactured.

Here, various desirable processing treatments performed in the ply machine X2 and units used in the same of the present invention will be described in more detail below.

On manufacturing the secondary paper roll R applied with the chemicals for the toilet roll in the ply machine X2, the processing speed is 300 to 900 m/minute, desirably 500 to 900 m/minute, and more desirably 700 to 800 m/minute. A processing speed of smaller than 300 m/minute cannot bring about sufficient productivity. Meanwhile, a processing speed of larger than 900 m/minute makes it difficult to manufacture the toilet paper stably. Particularly, it is preferable that the processing speed is 500 m/minute and particularly, 700 m/minute, because by doing so, the products can be supplied to the winder provided at the post stage, the stock can be sufficiently managed, and a plurality of winders can be operated, which leads to high productivity. A processing speed of 800 m/minute or less enables further stable operation.

Furthermore, in the present invention, a processing speed is at least 300 m/minute or more, normally 500 m/minute or more, and preferably of 700 m/minute or more, such processing speed is far higher from the viewpoint of productivity of the conventional toilet rolls.

Meanwhile, in the ply machine X2, a slitting unit 55 is provided at a previous stage of the winding portion 56. Then, the multi-ply continuous sheet S3 applied with the chemicals is slit to an appropriate width in the continuation direction, and the slit multi-ply continuous sheets S3 are wound, so that the sheets may become secondary paper rolls R each having an appropriate width in the winder provided at a post stage.

Furthermore, the slit herein is a width appropriate not to the width of the toilet roll but to that of the winder provided at the post stage, and it is substantially indicated that the multi-ply continuous sheet S3 is slit into a half or a third.

The slitting unit 55 for slitting may be configured so that a plurality of roll cutters and a plurality of receiving portions are provided in parallel in the width direction of the multi-ply continuous sheet S3 at a predetermined interval.

Meanwhile, in the ply machine X2, one or more calender unit 52 may be provided between the multi-ply forming unit 51 and the winding unit 56 so that calendering is performed on the multi-ply continuous sheets S2 and S3 before and after the application of the chemicals. In the example illustrated in the drawing, the calender units are provided at the post stage of the multi-ply forming unit 51 and at the previous stage of the chemicals applying unit 53, and such an arrangement is desirable.

The type of calender in the calender unit 52 is not particularly limited, but a soft calender or a chilled calender is desirable due to the improvement in smoothness and the adjustment of the paper thickness. The soft calender is one using a roll covered with an elastic material such as urethane rubber, while the chilled calender is one using a metal roll.

The number of the calender unit can be appropriately changed. When the pluralities of calender units are provided, there is an advantage that the surface of the sheet may be sufficiently smoothened even when the processing speed is fast. Then, there is an advantage that one calender units can be provided even in a narrow space.

In a case where two or more calender units are provided, these calender units can be provided in parallel in the horizontal direction, in the vertical direction, or in the inclination direction, and also can be provided by combining these manners. The calender units provided in parallel in the horizontal direction allows small embracing angle, and hence leads to high processing speed. The calender units provided in parallel in the vertical direction allows small installation space. The embracing angle used herein is, in a circle of a cross section of a roll (being perpendicular to a shaft of the roll), an angle generated when a portion of the circle contacting with a sheet, is viewed from a center of the circle (the same applies to the following description).

Paper making is performed with control factors including also, type of calender, nipping pressure, and number of nips in a calendering process, and each control factor is preferably changed depending on required quality of toilet paper such as paper thickness and surface property.

[Process in Winder: Log Manufacturing Process]

Figure 3:
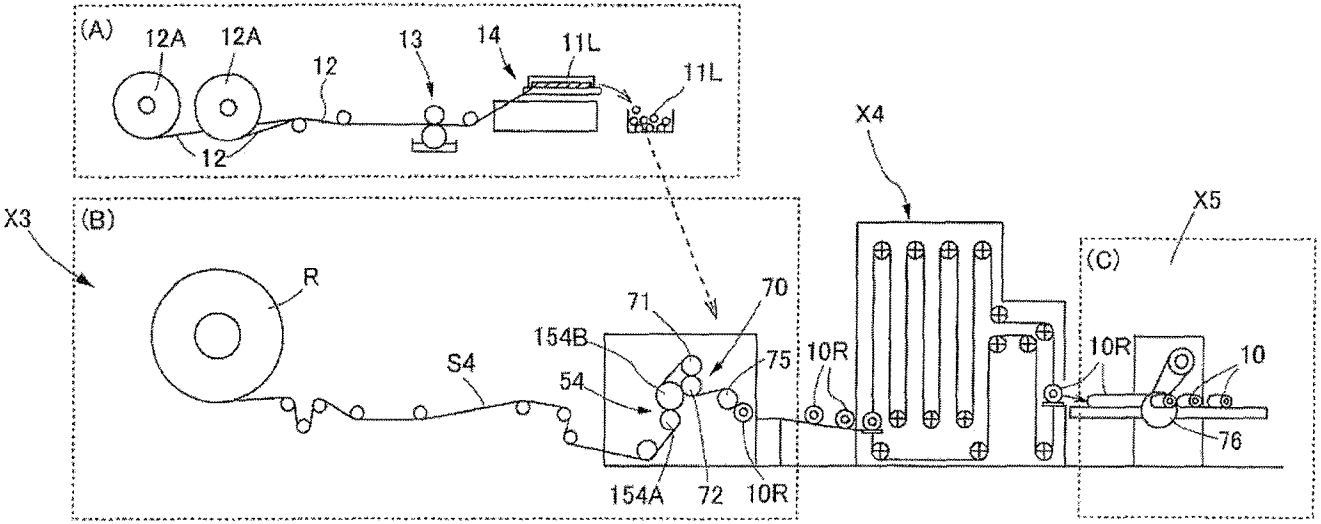
FIG. 3 is a schematic diagram illustrating an example of a method for manufacturing a log in a winder according to the first embodiment.

As described above, the secondary paper roll is manufactured by winding the multi-ply continuous sheet S3 applied with the chemicals in the ply machine X2, and after that it is conveyed to a winder X3 so as to manufacture a log 10R. In FIG. 3, FIG. 3(A) illustrates a process for manufacturing a long paper core 11L to be used for manufacturing the log, FIG. 3(B) illustrates a log manufacturing process, and FIG. 3(C) illustrates a cutting process (C). The part illustrated in (B) is the log manufacturing process in the winder. Here, the process (A) for manufacturing the long paper core 11L will be described.

Figure 4:
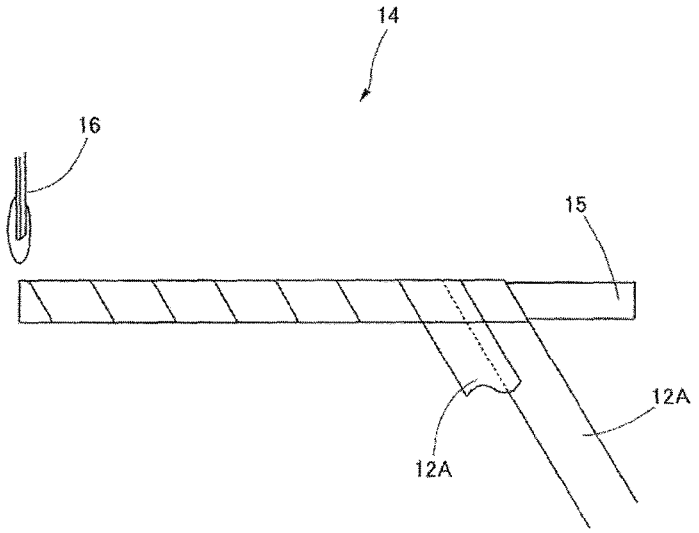
FIG. 4 is a schematic diagram illustrating a paper core manufacturing process.

As illustrated in also FIG. 4, in the process (FIG. 3(A)) for manufacturing the long paper core 11L, two sheets of band-like base paper (paperboards) 12 and 12 for the paper cores are glued by a gluing roll 13 at its predetermined positions while being reeled out from paper rolls 12A and 12A, are wound on a shaft 15 in a spiral shape by a core winder 14 while glued portions are overlapped, and are evenly cut into a predetermined length according to the width of the winder or the secondary paper roll R by a slitter 16, so that the cylindrical long paper core 11L is manufactured. Furthermore, the sheets of base paper 12, 12 for the paper cores can be different each other. For example, one of the sheets of base paper can be printed, or the respective basis weights thereof can be different each other. It is unnecessary also in the present invention that the sheets of base paper 12 and 12 are the same. Furthermore, it is desirable to set the diameter of the paper core to 35 to 50 mm.

Subsequently, the log 10R is manufactured by the winder X3 in parallel to or subsequently after the process for manufacturing the long paper core 11L. Furthermore, log 10R is an expression used in the filed of this art, and is an in-process material having the same diameter as that of a toilet roll and a width plural times the width of the toilet roll.

The winder X3 according to the first embodiment includes a paper roll support portion, a ply bonding unit 54, a perforation line applying unit 70 with a perforation roll 71, and a rewinding unit 75 which are provided in this order.

As for manufacturing of the log 10R in the first embodiment, a multi-ply continuous sheet S3 applied with the chemicals are wound by the secondary paper roll R set on the paper roll support portion in the winder X3; from this secondary paper roll R, a multi-ply-sheet S4 is continuously reeled out; on this multi-ply-sheet S4 from the secondary paper roll, a ply bonding is performed by the ply bonding unit 54; on the ply bonding performed multi-ply-sheet S4 from the secondary paper roll, perforation lines are further formed along the width direction thereof at a predetermined interval in the flow direction by the perforation line applying unit 70; and then the multi-ply-sheet S4 from the secondary paper roll is rewound to have the winding diameter of the toilet roll by the rewinding unit 75 so that the log 10R finally can be manufactured.

Figure 5:
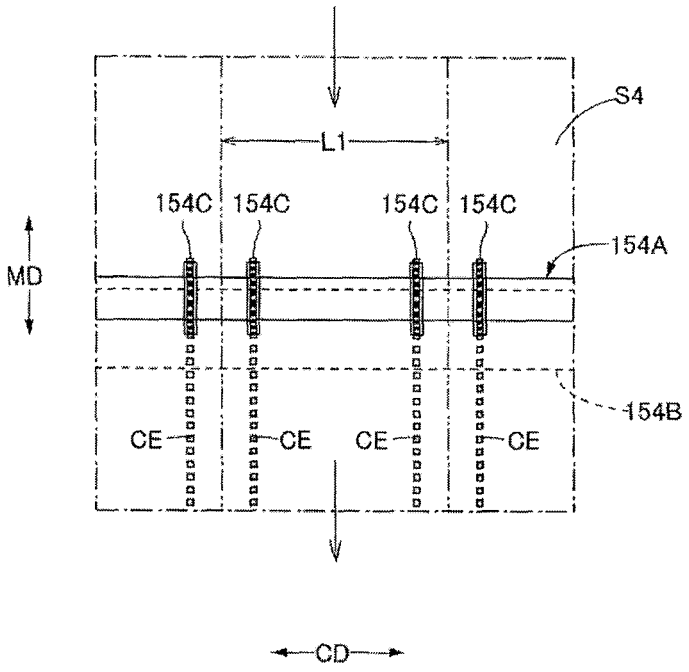
FIG. 5 is a schematic diagram illustrating a ply bonding process.

As illustrated in FIG. 5, the ply bonding unit (ply bonding process) 54 is configured so that a receiving roll 154B, which is a metal roll or an elastic roll, and a metallic rigid roller 154A, which has minute convex portions 154C formed on the surface thereof, are provided rotatably while the outer peripheral surfaces thereof abut against each other with a predetermined pressure. Then, the multi-ply-sheet S4 from the secondary paper roll is conveyed, while nipped between the receiving roll 154B and the convex portions 154C, which are respectively provided as many as two at each of left and right sides of a portion of the multi-ply-sheet S4 from the secondary paper roll, which is corresponding to the center in the width direction of the width L1 of the toilet roll. Thus, linear contact embosses CE can be formed on the multi-ply-sheet S4 from the secondary paper roll along the continuation direction of the multi-ply-sheet S4 from the secondary paper roll so as to prevent the ply-separating.

Furthermore, it is desirable to manufacture the log 10R by winding the multi-ply-sheet S4 from the secondary paper roll in the rewinding unit 75 provided at the post stage, while the surface facing the roller 154A provided for forming the contact embosses CE is set to become an outer peripheral side surface.

The contact embosses CE applied in this way make it possible to prevent the ply-separating of the multi-ply-sheet S4 from the secondary paper roll, which is formed by multi-ply forming of the plurality of single-sheets (S11 and S12) from the primary paper rolls.

Further, in the embodiment, the ply bonding process 54 uses the metallic rigid roller 154A having the minutes convex portions 154C formed on the surface thereof as the roller 154A. Not being limited to this, any manner may be employed as long as a linear bonding portion is formed on the multi-ply-sheet S4 from the secondary paper roll for preventing the ply-separating. For example, a roller having minute needle-like members formed on the surface thereof may be used as the roller instead of the roller 154A.

Further, the ply bonding unit is not limited to the above-described example. That is, a roller may be used in which a tip of a convex portion is formed in a dot shape, a square shape, a rectangular shape, a circular shape, an oval shape, or the like or a roller may be used in which a tip of a convex portion is formed in a thin and elongated shape or a thin and inclined linear shape.

Meanwhile, an arrangement is considered in which the convex portions are arranged at the same interval. However, the convex portions can be arranged in a zigzag shape and they are not necessary to be arranged at the same interval. Further, an arrangement may be considered in which two rows of convex portions are arranged instead of the arrangement in which one row of convex portions are arranged so as to continuously form the contact emboss. Then, plural groups of convex portions may be arranged to form plural rows of the contact embosses in a closely arranged state so that the plurality of ply bonding groups are formed.

Furthermore, as the bonding process, another bonding unit using an ultrasonic wave or the like may be used instead of the above-described mechanical pressure bonding unit.

Furthermore, in the example illustrated in the drawing, the ply bonding unit 54 is provided in the winder X3. However, in the embodiment, a configuration may be employed in which the ply bonding unit is provided at the post stage of the multi-ply forming unit 51 in the ply machine X2 so as to manufacture the secondary paper roll applied with the ply bonding in advance. In this case, by utilizing the secondary paper roll applied with the ply bonding, the ply bonding is not applied in the winder X3. Furthermore, in the ply bonding, which is applied by the ply machine X2 in this way, if the slitting process is performed in the ply machine X2, it is preferable that the ply bonding is performed at the previous stage of the slitting process and it is more preferable that the ply bonding is performed also at the post stage of the chemicals applying unit 53.

Meanwhile, the perforation line applying unit 70 in the winder X3 includes the so-called perforation roll 71, which has a blade row with a plurality of blades arranged on the peripheral surface along the axial direction, and a receiving roll 72, which makes a pair with the roll 71, and when the multi-ply-sheet S4 from the secondary paper roll passes between the perforation roll 71 and the receiving roll 72, the saw blade of the perforation roll 71 contacts the multi-ply-sheet S4 from the secondary paper roll so that the perforation line is formed on the multi-ply-sheet S4 from the secondary paper roll. Plural rows of the saw blades of the perforation roll 71 are formed on the peripheral surface with a gap therebetween, and the perforation lines are formed at a predetermined interval in the flow direction of the multi-ply-sheet S4 from the secondary paper roll by the rotation of the perforation roll 71.

Here, in the toilet roll according to the present invention, the tensile strength of the multi-ply-sheet S4 from the secondary paper roll in the length direction at the perforation line may be appropriately 10 to 200 cN (desirably 40 to 60 cN). This range preferably makes it possible to reduce remarkably a risk that the sheet is accidentally torn at the perforation line during the manufacturing process, while the range makes it possible to cut reliably the sheet at the perforation line in using the toilet roll. Here, the "tensile strength in the length direction of the multi-ply-sheet from the secondary paper roll at the perforation line" indicates the dry tensile strength, which is measured based on the tensile strength test method specified by JIS P 8113, and indicates not a sheet as it is, i.e., a sheet without a perforation line, but the sheet with the perforation line, and such tensile strength is measured across the perforation line.

The tensile strength in the length direction at the perforation line can be controlled by adjusting paper strength, basis weight and the like of the multi-ply-sheet S4 from the secondary paper roll, and by adjusting length of a tie as a connection portion and length of a cut as a cut portion in the perforation line, or by adjusting a tie-cut ratio, i.e., a ratio between the tie length and the cut length.

More specifically, the tie-cut ratio can be adjusted by using a blade row having a desired tie-cut length and a desired tie-cut ratio. Further, the tensile strength may be also adjusted by linear pressing pressure applied from the perforation roll to the sheet (the pressing force (kgf/cm) applied to the sheet per unit sheet width) or the winder speed (the winding speed).

Furthermore, in a preferable configuration of the perforation line of the present invention, the cut length is 0.9 to 37.5 mm and the tie-cut ratio (tie:cut) is 1:15 to 1:1.

Meanwhile, the winder X3 includes a shaft, a driving device for rotating the shaft, and a gluing device. The long paper core 11L, which has been manufactured in the long paper core manufacturing process (FIG. 3(A)), is inserted into the shaft. Then, in manufacturing the log 10R, the shaft is first inserted into the long paper core 11L, and appropriate glue is applied to the outer surface of the paper core while the shaft is inserted into the core.

Subsequently, the tip edge of the multi-ply-sheet S4 from the secondary paper roll adheres to the long paper core 11L with the adhesive glue, and then the shaft is rotationally driven so that the multi-ply-sheet S4 from the secondary paper roll is wound on the long paper core 11L.

Then, the multi-ply-sheet S4 from the secondary paper roll having a predetermined length corresponding to the toilet roll is wound on the long paper core 11L so as to form a roll having a winding diameter (diameter) corresponding to the toilet roll and having a width plural times or more the width of the toilet roll, the rotational driving of the shaft is stopped, and the subsequent multi-ply-sheet S4 from the secondary paper roll is cut so as to form the log 10R.

Furthermore, a portion (referred to as a tail), which is to be a free end by cutting the subsequent multi-ply-sheet from the secondary paper roll, adheres to the core outer surface by a known tail sealer mechanism through adhesive glue or the like.

Here, as the preferable glue for the use of adhering the multi-ply-sheet S4 from the secondary paper roll to the outer surface of the long paper core 11L or adhering the wound tail to the core outer surface, there are an acrylate resin, PVA (polyvinyl alcohol), CMC (sodium carboxymethyl cellulose), starch, just water, and the like, which do not disturb the water disintegration property of the toilet paper. That is, known water-based glue can be used preferably.

Furthermore, it is preferable a winding diameter of the log is 100 to 120 mm and a winding length of the log is 20 to 120 m, because such winding diameter and winding length hardly cause deviation in winding in the rewinding process.

[Cutting Process by Log Cutter]

After the log 10R is manufactured in the winder X3, the log is continuously or intermittently conveyed to a log accumulator X4. The log accumulator X4 is a known device, which moves the log 10R in the height direction and in the transverse direction so that the plural logs 10R are stocked and conveyed to a log cutter X5 provided at the post stage.

As for the logs, which are sequentially conveyed from the log accumulator X4 to the log cutter X5, both ends of the log in the width direction are trimmed if necessary, and is cut into the width of the toilet roll so as to form individual toilet rolls 10. The log cutter X5 includes round blades 76, which are arranged at plural intervals so as to contact the peripheral surface of the log 10R, and the log 10R is cut into the width of the toilet roll 10 by such round blades.

Figure 6:
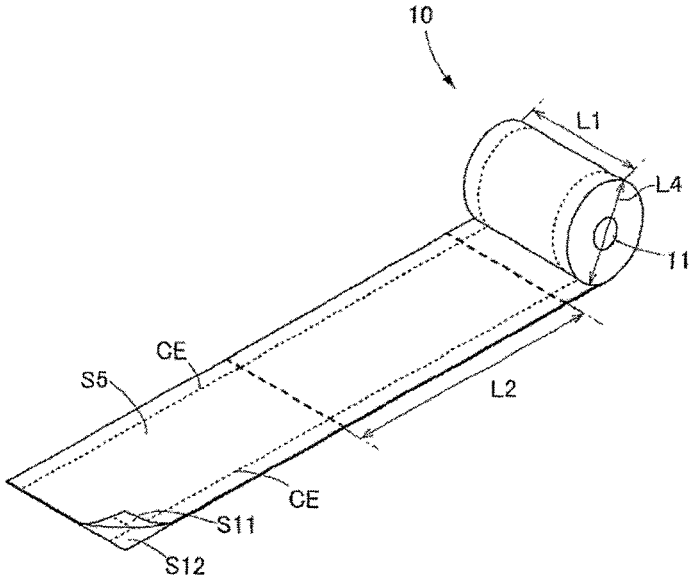
FIG. 6 is a perspective view of a toilet roll.

Thus, the toilet rolls 10 are manufactured, in each of which, toilet paper S5 is wound on the paper core 11. As illustrated in FIG. 6, the manufactured toilet roll is completed by winding the toilet paper S5, which is obtained by cutting the multi-ply-sheet S4 from the secondary paper roll, on the paper core 11 obtained by cutting the long paper core 11L.

Here, as a preferred example of the toilet roll 10 according to the present invention, as illustrated in FIG. 6, the width L1 is 100 to 115 mm, the diameter L4 is 100 to 120 mm, the winding length (the entire length of the toilet paper) is 18 to 70 m, and the diameter of the paper core is 35 to 50 mm. The perforation line interval L2 is 100 to 300 mm. The chemicals application performed in the winder X3 originally causes problems: e.g., deviation in winding due to protrusion of the log at a portion near the paper core; loosing shape of the log due to permeation of the chemicals; paper breakage occurred on forming perforation and the like. Due to these problems, it was so difficult to manufacture the toilet roll 10. However, the manufacturing of toilet roll 10 having the above mentioned dimensions can be attained easily by employing the method in accordance with the present invention.

Further, as for the toilet paper according to the present invention, it can be ensured that the water disintegration property test method specified by at least JIS P 4501 brings about 80 seconds or less. The water disintegration property of 80 seconds or more indicates that the water disintegration is too slow. For example, when the toilet paper having such a water disintegration property is disposed in a flush toilet or the like, a drainpipe may be blocked therewith. Particularly, in the toilet paper according to the present invention, it is possible to attain the water disintegration property of 35 seconds or less, which has been difficult for conventional toilet paper applied with chemicals. That is, the present invention may highly efficiently manufacture the toilet roll made of the toilet paper having a sufficient water disintegration property.

[Packing Process]

Figure 7:
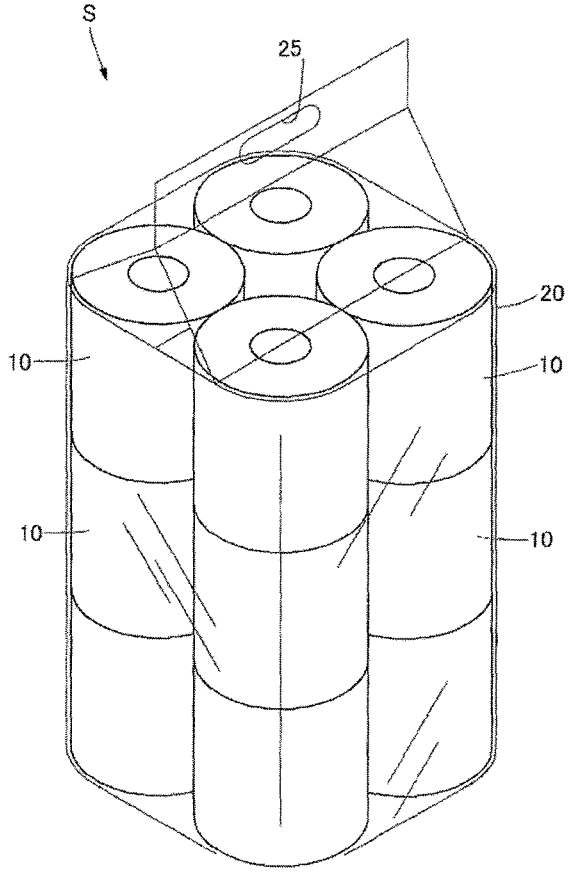
FIG. 7 is a perspective view illustrating an example of toilet roll products.
Figure 8:
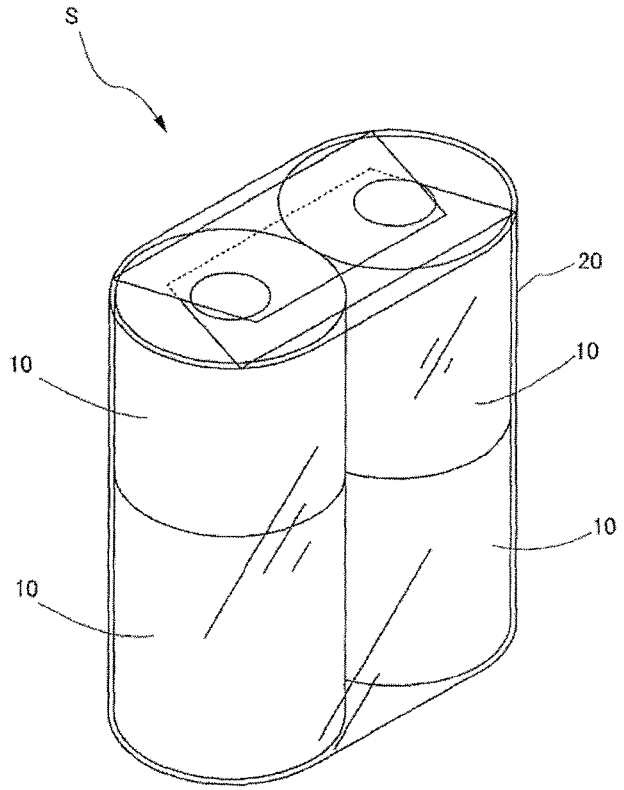
FIG. 8 is a perspective view illustrating another example of toilet roll products.

After the toilet roll 10 is manufactured, an appropriate number of these toilet rolls are packed with an outer film or the like by a known packing technique so as to obtain toilet roll products S. The examples of the toilet roll products S are illustrated in FIGS. 7 and 8, respectively.

Regarding the packing, a cylindrical outer film base material is developed, an appropriate number of toilet rolls are pressed thereinto, as they are, a part of the outer film base material is thermally weld for bonding so that another part of the outer film base material is not affected by the bonding, the outer film 20 covers the toilet rolls so as to contact tightly or almost do so to the peripheral surfaces of the toilet rolls, while the toilet rolls cannot move, for bundling the toilet rolls without disorganization of the arrangement of toilet rolls.

Here, as specific examples of the outer film 20, there are polyethylene film such as HDPE (high-density polyethylene) film, LDPE (low-density polyethylene) film, and LLDPE (linear low-density polyethylene) film, polystyrene film, polypropylene film, or multi-ply film composed of some of the above films. Due to the low cost, the appropriate tearing property, and the appropriate strength, the HDPE film, the LDPE film, and a film obtained by combining HDPE and LDPE are appropriate. Further, multi-ply film cab be used in which a paper layer or a non-woven fabric layer is multi-plied on the above resin-based film.

Furthermore, gusset packing, caramel packing, shrink packing, and the like are known and used as specific packing. In the gusset packing illustrated in FIG. 7, the number 4×3=12 of toilet rolls are arranged such that four toilet rolls are disposed in one set while the respective peripheral surfaces contact one another, and three stages, each of which consists of one set of four toilet rolls, overlap one another while the end surfaces face one another, and a handle 25 is formed at the upper end portion thereof. In the caramel packing illustrated in FIG. 8, the number 2×2=4 of toilet rolls are arranged such that two toilet rolls are disposed in one set while the respective peripheral surfaces contact each other, and two stages, each of which consists of one set of two toilet rolls, overlap each other while the end surfaces thereof face each other.

The toilet roll products according to the first embodiment are manufactured according to the above processes.

"Second Embodiment: Single Embossing is Performed by Ply Machine"

Subsequently, the second embodiment of the present invention will be described by particularly referring to FIGS. 9 and 10. The second embodiment is the same as the first embodiment except that so-called single embossing is performed on multi-ply continuous sheets S2 and S3 in the ply machine X2, thus, the other matters are as stated before.

Figure 9:
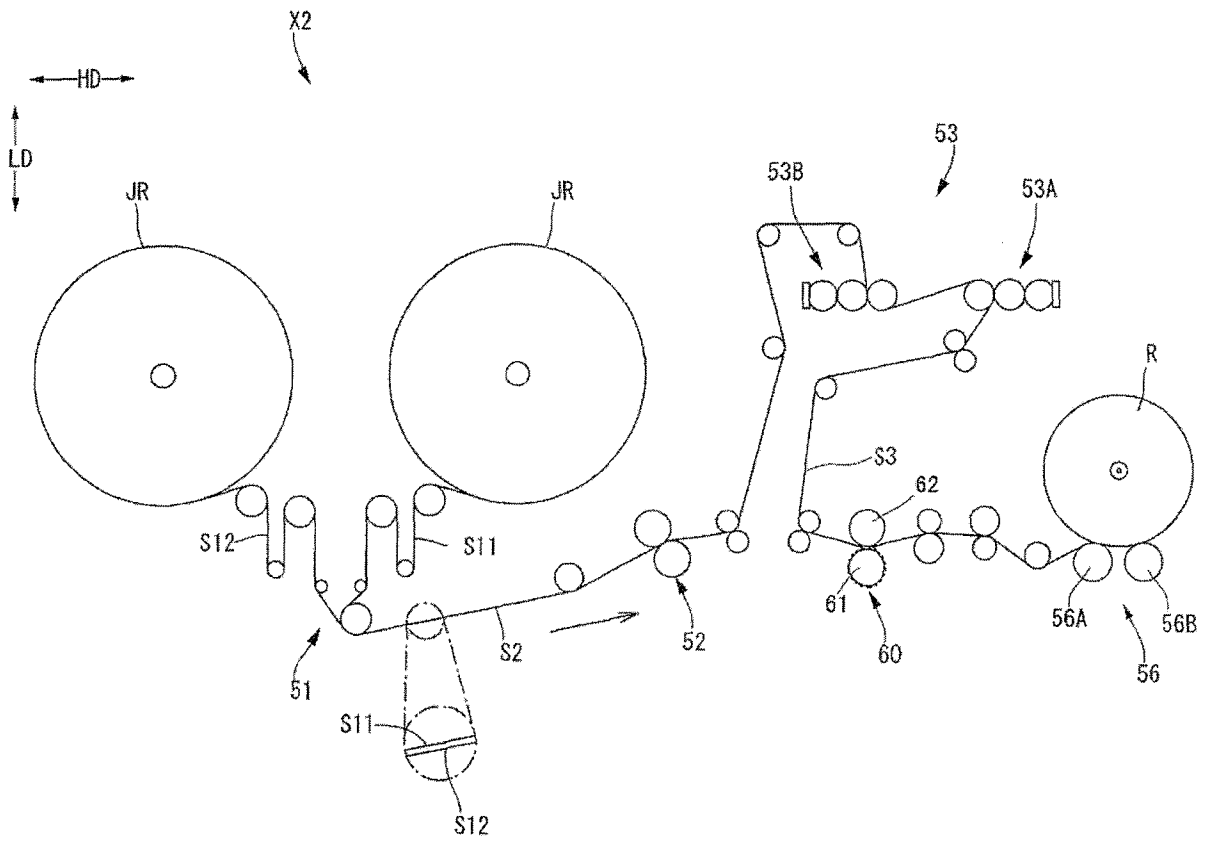
FIG. 9 is a schematic diagram illustrating an example of a method for manufacturing a secondary paper roll in a ply machine according to the second embodiment.

As illustrated in FIG. 9, in the ply machine X2 according to the second embodiment, an embossing unit 60 is provided at the post stage of a chemicals applying unit 53. Then, in the embossing unit 60, embossing is performed on the multi-ply continuous sheet S3 applied with chemicals by the chemicals applying unit 53. Furthermore, the embossing mentioned herein is different from the above mentioned ply-bonding CE, which prevents the ply-separating and is applied to the entire sheet surface so as to improve bulkiness, design property, and surface property of the sheet, referred to as micro embossing, macro embossing, design embossing, or the like.

The embossing unit 60 includes an embossing roll 61, which has embossing convex portions formed on the peripheral surface thereof, and a nipping roll 62, which makes a pair with the embossing roll. Then, by passing the multi-ply continuous sheet S3 between the embossing roll 61 and the nipping roll 62, the embossing pattern of the peripheral surface of the embossing roll is transferred to the multi-ply continuous sheet S3 to perform embossing thereon.

Figure 10:
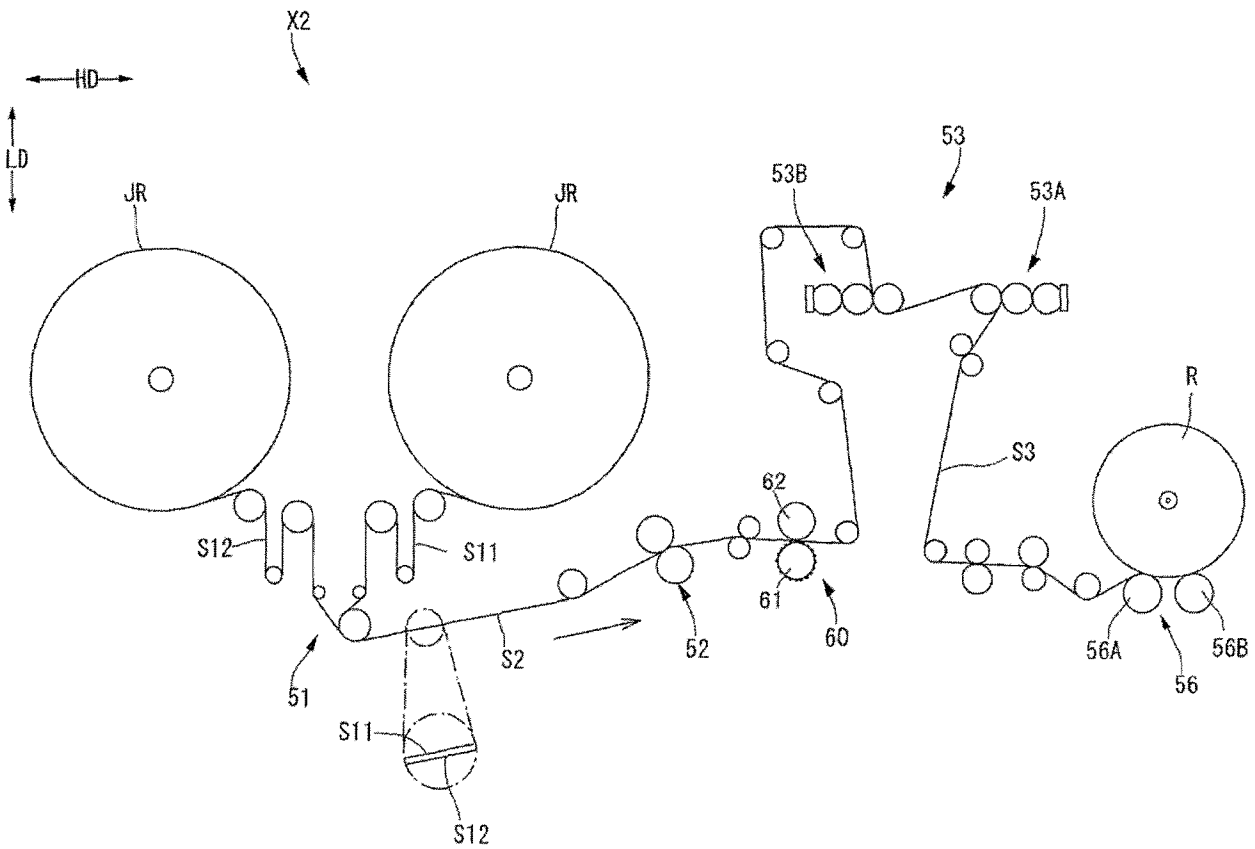
FIG. 10 is a schematic diagram illustrating another example of a method for manufacturing a secondary paper roll in the ply machine according to the second embodiment.

Furthermore, as for a position of the embossing unit 60, it is also possible to provide the embossing unit 60 before the chemicals applying unit 53 as long as provided at the post stage of the multi-ply forming unit 51, as illustrated in FIG. 10. However, the chemicals applied after the embossing process is likely to make the shape of emboss pattern to be lost. For this reason, the position of FIG. 9 is desirable in which the embossing unit is provided at the post stage of the multi-ply forming unit 51 and the post stage of the chemicals applying unit 53.

Meanwhile, the preferred embossing unit 60 of the present invention is steel-rubber type where, the embossing roll 61 is made of metal, and the nipping roll 62 is an elastic nipping roll configured so that at least the surface thereof is formed of an elastic member such as rubber. Such a steel-rubber type embossing unit can be appropriately used in the high-speed process in the ply machine X2.

Shore hardness of the surface of the elastic nipping roll 62 is preferably 40 to 60°. Too low Shore hardness, that is, too soft elastic roll surface may cause paper breakage in the sheet or the paper sheet, which leads to a concern that the high-speed operation of the ply machine may be disturbed. Meanwhile, too high Shore, that is, too rigid elastic roll surface leads to a concern that the embossing may not be performed.

When embossing is performed on the multi-ply continuous sheet, the nipping pressure (also referred to as embossing pressure or linear pressure) is 5 to 30 kgf/cm and desirably, 10 to 25 kgf/cm. Too low nipping pressure leads to a concern that the sharp embossing effect may not be sufficiently exhibited. Meanwhile, too high embossing pressure leads to a concern that sanitary tissue paper to be processed may be torn.

In the present invention, the embossing pattern, the embossing depth, the embossing density, the individual embossing shape forming the embossing, and the embossing area are not particularly limited. However, exemplified are so-called micro embossing, in which embossing is performed on the entire sheet surface with the embossing density of 30 to 100 units/cm$^2$ and the embossing depth of 0.2 to 2.0 mm, and design embossing, in which a pattern is drawn with the embossing density of 0.1 to 10 units/cm$^2$ and the embossing depth of 0.3 to 2.5 mm. The micro embossing is particularly desirable.

Here, in the embossing of the second embodiment, so-called single embossing is performed. That is, the embossing is performed so that embossing convex portions are pressed against only one surface of the multi-ply continuous sheet S3. Thus, in the multi-ply continuous sheet S3, which is subjected to the embossing, one surface is provided with only embossing concave portions corresponding to embossing convex portions, and the opposite surface is provided with only the embossing convex portions corresponding to the embossing concave portions. In a case of the single embossing, embossing is performed on the multi-ply continuous sheet S3 with comparatively strong paper strength, and hence there is an excellent advantage that the ply machine X3 may be operated at a high speed. Further, the single-sheets S11 and S12, which are reeled from the primary paper rolls respectively so as to form the multi-ply continuous sheet S3, can be sufficiently multi-plied in a unified manner.

Therefore, in the second embodiment, it is possible to avoid ply bonding mentioned in the first embodiment. By not doing the ply bonding, a manufacturing speed in the winder X3 can be improved.

"Third Embodiment: Double Embossing is Performed by Ply Machine"

Subsequently, the third embodiment of the present invention will be described by particularly referring to FIG. 11. The third embodiment is the same as the first embodiment except that so-called double embossing is performed on a multi-ply continuous sheet in the ply machine X2, and by employing this configuration, some requirements related thereto are caused, thus, the other matters are as stated before. Further, as for an embossing unit 60, a structure in which the embossing is performed, conditions for embossing, and the like are the same as those of the second embodiment, and these matters are as stated before.

Hereinafter, difference from the first embodiment and the second embodiment will be described in detail.

Figure 11:
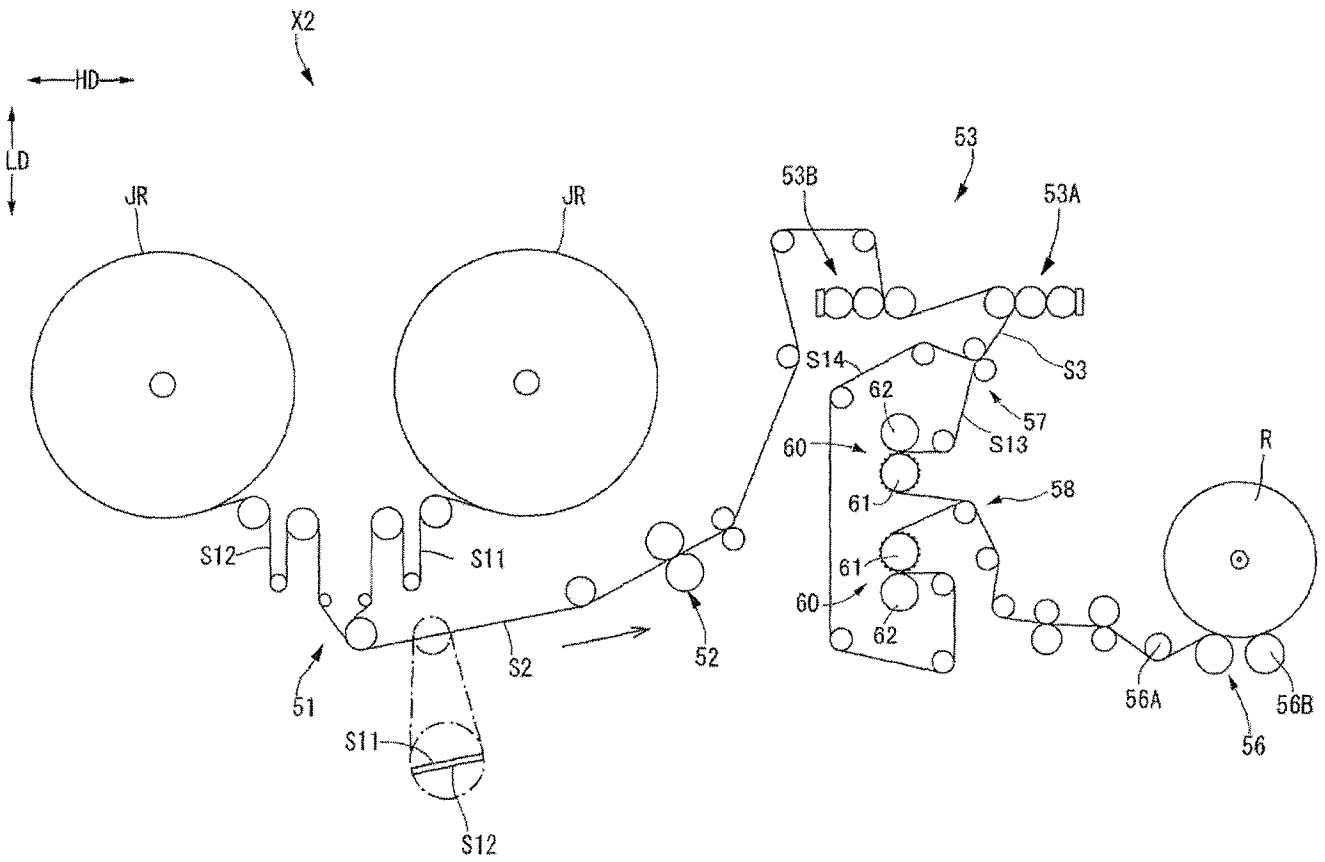
FIG. 11 is a schematic diagram illustrating an example of a method for manufacturing a secondary paper roll in a ply machine according to the third embodiment.

The ply-machine X2 according to the third embodiment illustrated in FIG. 11 is sequentially provided with a multi-ply forming unit 51, which performs multi-ply forming on single-sheets S1 and S12 from primary paper rolls so as to form a multi-ply continuous sheet, a chemicals applying unit 53, which applies chemicals to the multi-ply continuous sheet S2 from the multi-ply forming unit 51, a ply-separating unit 57, which separates the multi-ply continuous sheet S3 applied with chemicals into respective continuous sheets S13, S14 applied with the chemicals, embossing units 60, 60, which perform embossing on the respective continuous sheets S13, S14 separated by the ply-separating unit 57, and a re-multi-ply forming unit 58, which performs re-multi-ply forming the respective continuous sheets S13 and S14 embossed by the embossing units 60, 60, thereby chemicals applying, embossing on the respective continuous sheets, and the substantial multi-ply forming are performed in this order.

In the embodiment, in the re-multi-ply forming process by the re-multi-ply forming unit 58, it is desirable to perform multi-ply forming on the respective continuous sheets S13 and S14 so that the surfaces contacting the embossing rolls of the respective embossing units 60, 60, that is, the surfaces to have the embossing concave portions become the outer surfaces of the multi-ply continuous sheet and the embossing convex surfaces face each other. By doing so, there is an advantage that an air gap is formed between the respective continuous sheets after the multi-ply forming so that a fluffy multi-ply continuous sheet can be obtained.

Figure 12:
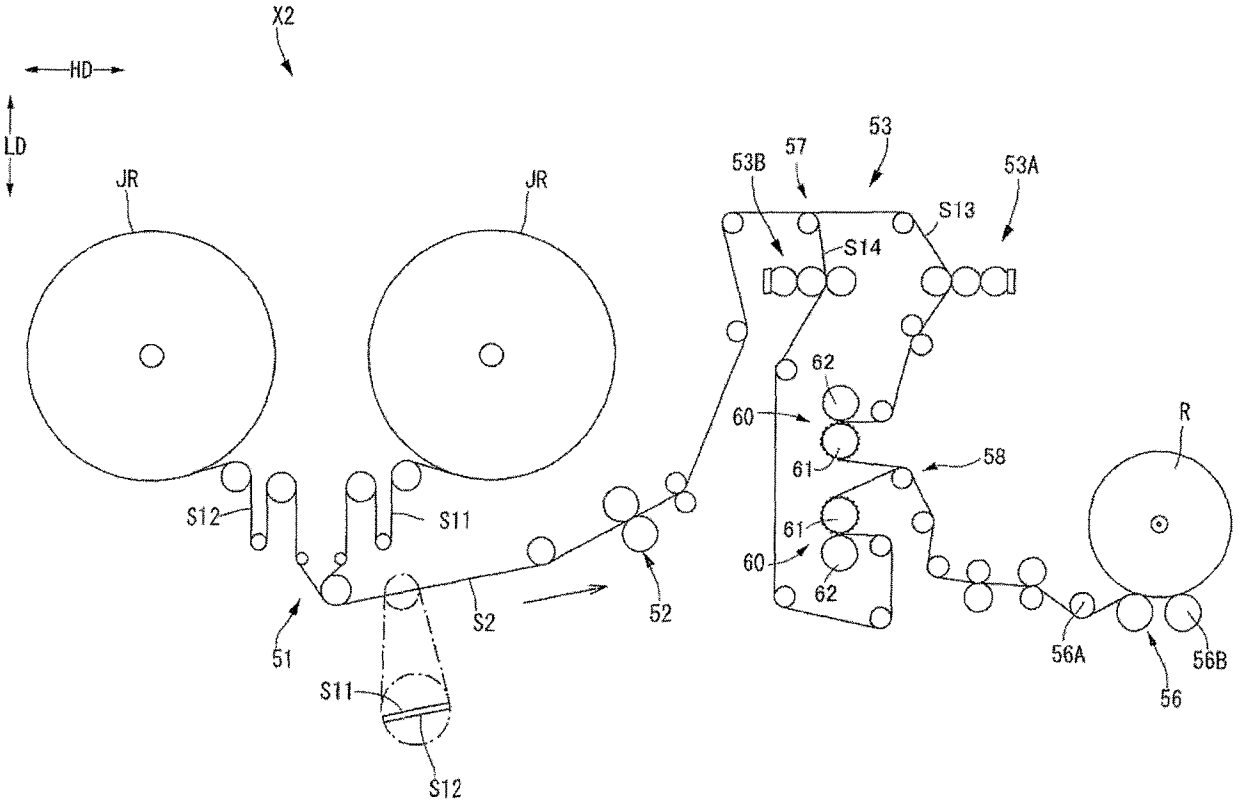
FIG. 12 is a schematic diagram illustrating another example of a method for manufacturing a secondary paper roll in the ply machine according to the third embodiment.

Furthermore, in the third embodiment, as illustrated in FIG. 12, by the ply machine X2, where the ply-separating unit 57 is provided at the previous stage of the chemicals applying unit 53 so that the chemicals applying and the embossing may be performed on the respective continuous sheets S13, S14, which have been separated from each other from the plied state and after that, re-multi-ply forming is performed on the respective continuous sheets S13, S14 by the re-multi-ply forming unit 58. In this case, after re-multi-ply forming in the re-multi-ply forming unit 58, it is preferable that the chemicals are applied to one surface of the surfaces forming the respective outer surfaces of the multi-ply continuous sheet S13 and S14. Since the chemicals are applied to one surface, it is possible to reduce degradation in paper strength caused by the application of the chemicals.

Furthermore, in the examples illustrated in FIGS. 11 and 12, the respective embossing units 60, 60 are arranged at the post stages of the chemicals applying unit 53, but the ply-separating unit 57 and the embossing units 60 and 60 may be disposed at the previous stage of the chemicals applying unit 53. Further, the multi-ply continuous sheet applied with the chemicals may be obtained in a manner such that the chemicals applying and the embossing are performed without performing multi-ply forming on the single-sheets from the primary paper rolls in the multi-ply forming unit 51, that is, re-multi-ply forming unit 58 is used for the first multi-ply forming step so as to obtain a multi-ply continuous sheet applied with the chemicals.

However, the chemicals applying performed after the embossing makes easily the embossing shape to be lost. For this reason, in the double embossing type of the third embodiment, as illustrated in FIGS. 11 and 12, it is desirable to dispose the embossing unit 60 at the previous stage of the re-multi-ply forming unit 58 and at the post stage of the chemicals applying unit 53.

In the third embodiment, it is desirable to perform the ply bonding in the ply machine, the winder.

It should be noted that, in the third embodiment, the re-multi-ply forming unit 58 serves as the multi-ply forming unit, because it performs the substantial multi-ply forming in the ply machine X2.

"Fourth Embodiment: Single Embossing is Performed by Winder"

Figure 13:
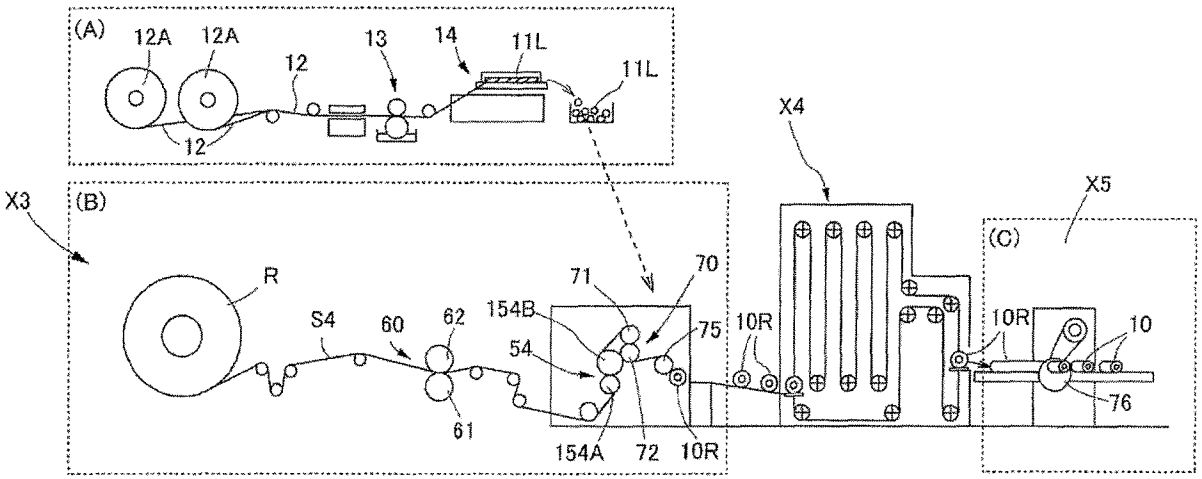
FIG. 13 is a schematic diagram illustrating an example of a method for manufacturing a log in a winder according to the fourth embodiment.

Subsequently, the fourth embodiment of the present invention will be described by particularly referring to FIG. 13. Furthermore, in the embodiment, so-called single embossing is performed in a winder X3. The embodiment is the same as the first embodiment except that the single embossing is performed in the winder X3 and by employing this configuration, some requirements related thereto are caused, thus, the other matters are as stated before. Further, as for an embossing unit, a structure in which the embossing is performed, conditions for embossing, and the like are the same as those of the second embodiment, and these matters are as stated before.

In the fourth embodiment, a multi-ply-sheet S4 from a secondary paper roll applied with chemicals in the winder X3 is reeled out, and is embossed at the previous stage of the perforation line applying unit 70.

In the fourth embodiment, the chemicals are applied, and then, the embossing is performed on the multi-ply-sheet S4 from the secondary paper roll, which was wound once by the secondary paper roll and, after that, has been reeled out from the secondary paper roll. For this reason, since the chemicals sufficiently diffuse inside the multi-ply-sheet S4 from the secondary paper roll, it is possible to improve the speed and to perform the stable manufacturing process by reducing the concern of paper breakage in the perforation line applying unit. Furthermore, it is possible to perform the clear embossing in the embossing unit.

"Fifth Embodiment: Double Embossing is Performed by Winder"

Figure 14:
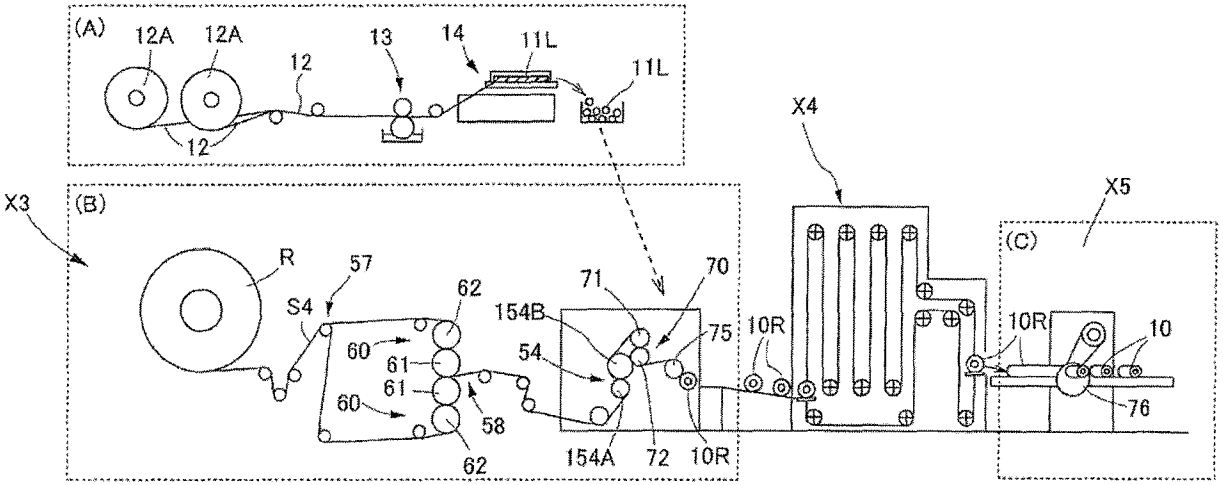
FIG. 14 is a schematic diagram illustrating an example of a method for manufacturing a log in a winder according to the a fifth embodiment.
Figure 15:
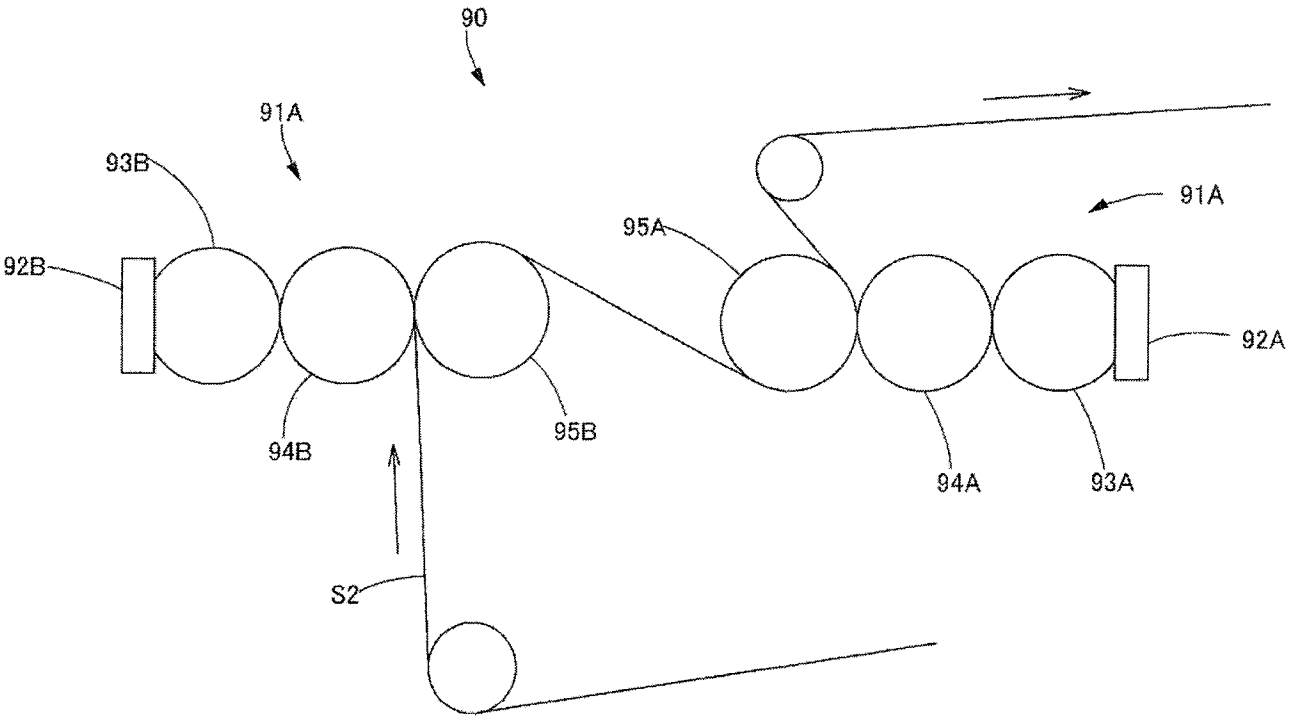
FIG. 15 is a schematic diagram illustrating an example of a chemicals applying unit.

Subsequently, the fifth embodiment of the present invention will be described by particularly referring to FIG. 14. Furthermore, in the embodiment, so-called double embossing is performed in a winder X3. The embodiment is the same as the first embodiment except that the double embossing is performed in the winder and by employing this configuration, some requirements related thereto are caused, thus, the other matters are as stated before. Further, as for an embossing unit, a configuration the embossing is performed, embossing conditions, and the like are the same as those of the second embodiment, and these matters are stated above.

The winder X3 of the fifth embodiment is sequentially provided with a ply-separating unit 57, embossing units 60, 60, and a re-multi-ply forming unit 58 at the previous stage of the perforation line applying unit 70 in this order. Then, a multi-ply-sheet S4 from a secondary paper roll applied with chemicals is reeled out, after that, the multi-ply-sheet S4 from the secondary paper roll is once separated into plural continuous sheets S13 and S14 from plied state by the ply-separating unit 57, the embossing is performed on the respective continuous sheets in embossing unit 60, 60 at the previous stage of the perforation line applying unit 70, and then the respective continuous sheets are re-multi-plied in the re-multi-ply forming unit 58.

In the fifth embodiment, as in the third embodiment, the chemicals are applied, and then, the embossing is performed on the multi-ply-sheet S4 (S13, S14) from the secondary paper roll, which was once wound by the secondary paper roll and, after that, has been reeled out from the secondary paper roll. For this reason, since the chemicals sufficiently diffuse inside the multi-ply-sheet S4 (S13, S14) from the secondary paper roll, it is possible to improve the speed and to perform the stable manufacturing process by reducing the concern of paper breakage in the perforation line applying unit. Furthermore, it is possible to perform the clear embossing in the embossing unit.

In the embodiment, it is desirable to provide the ply bonding unit 54 at the post stage of the re-multi-ply forming unit 58 and the previous stage of the perforation line applying unit 70, in order to prevent the ply-peeling by performing the ply bonding at such a stage.

"Sixth Embodiment: Double Embossing is Performed by Winder"

Figure 30:
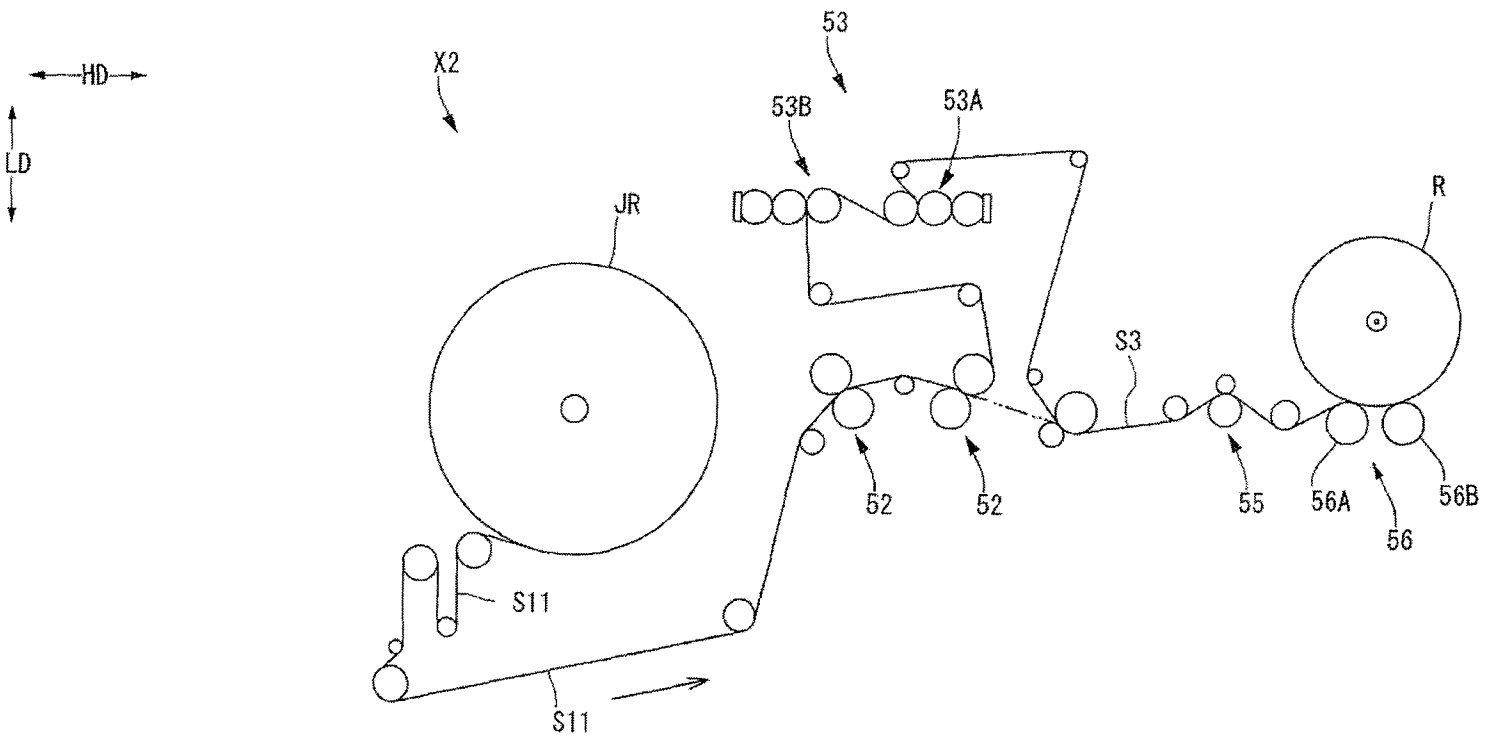
FIG. 30 is a schematic diagram illustrating another example of a method for manufacturing a secondary paper roll in a ply machine according to the sixth embodiment.
Figure 31:
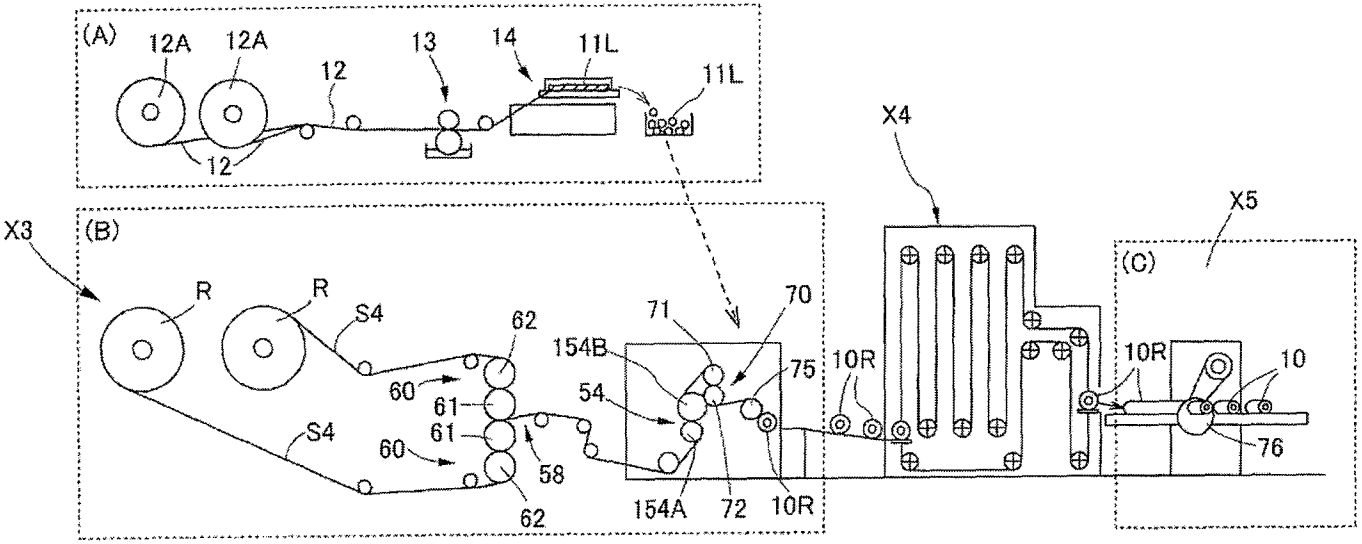
FIG. 31 is a schematic diagram illustrating an example of a method for manufacturing a log in a winder according to the sixth embodiment.

Subsequently, the sixth embodiment of the present invention will be described by particularly referring to FIGS. 30 and 31. In the embodiment, the secondary paper roll is manufactured by winding a single layered continuous sheet from a primary paper roll without operation of multi-ply forming unit in the ply machine X2, so that plurality of secondary paper rolls manufactured by winding primary single layered paper rolls are set in the winder X3, where the multi-ply-sheets from the secondary paper rolls reeled out from the respective secondary paper rolls are multi-plied. It is possible to prevent the operation of the multi-ply forming unit in the ply machine X2, by reeled out the single layered continuous sheet from the just one primary paper roll. The embodiment is the same as the first embodiment except that the multi-ply forming is not performed, thus, the other matters are as stated before.

In the configuration illustrated in the drawings, the winder X3 is sequentially provided with an embossing unit 60, a multi-ply forming unit 58, and a perforation line applying unit in this order. Then, the single layered sheets from the respective secondary paper rolls applied with the chemicals in the ply machine X2 are reeled out from the respective secondary paper rolls in the winder, and then, the respective single layered sheets S4 and S4 from the secondary paper rolls are embossed by the embossing unit, and multi-plied.

That is, in the configuration illustrated in the drawings, the single layered sheet from the secondary paper roll is formed in the ply machine X2 of the fifth embodiment, after that, the plurality of secondary paper rolls are set in the winder X3 of this embodiment, while a ply-separating unit 57 is not provided. Also in the sixth embodiment illustrated in the drawings, the same operation and effect as those of the fifth embodiment are obtained.

Furthermore, in the embodiment, it is preferable that a ply bonding unit 154 is provided at the post stage of the multi-ply forming unit 58 and at the previous stage of the perforation line applying unit 70 in order to prevent the ply-separating due to ply bonding at such a stage.

Meanwhile, although not illustrated, as another example of the sixth embodiment, a configuration may be employed, in which the multi-ply forming unit is provided at the previous stage of the embossing unit and single embossing is performed on the multi-ply continuous sheet by the embossing unit. Additionally, as further another example, a configuration can be proposed in which embossing is not performed.

Furthermore, the specific configuration of the multi-ply forming unit 58 in the winder is not largely different from the specific configuration of the multi-ply forming unit of the ply machine X2. The configuration described for the ply machine X2 of the first embodiment can be employed here. Further, as for an embossing unit, a configuration the embossing is performed, embossing conditions, and the like are the same as those of the second embodiment, and these matters are stated above.

"Specific Example of Chemicals Applying Unit in Ply Machine"

The specific example of the chemicals applying unit (the chemicals applying process) 53 of the ply machine X2, which is common in all embodiments from the first to the sixth, will be described closely below.

[Flexographic Printing]

An example, which uses a flexographic printer as a chemicals applying unit 53, is illustrated in FIGS. 15 to 21. Since a resinous and elastic printing plate cylinder is used in the flexographic printing, somewhat uneven crape of each surface of a multi-ply continuous sheet S2 or of a respective continuous sheet S13, S14 (hereinafter, referred to as a unit multi-ply continuous sheet S2 or the like) can be controlled by adjusting a printing pressure, achieving uniform application. Moreover, even in rapid application of 500 m/minute or more, further of 700 m/minute, a multi-ply continuous sheet S3 or the like, which has been applied with chemicals, is unlikely to be wrinkled. Further, it is possible to handle a wide range of viscosity of the chemicals with only one roll. Accordingly, there is an advantage in management and facility maintenance, and also in enhancement of productivity.

Here, in a case where the chemicals are applied onto the multi-ply continuous sheet S2 or the like at a high speed in the ply machine X2, line count of a flexographic printing plate cylinder is 5 to 60, preferably 10 to 40, and more preferably 15 to 35. The line count of smaller than 5 causes a lot of unevenness of application. Meanwhile, the line count of more than 60 causes clogging due to paper dust.

Line count of an anilox roll is 10 to 300, preferably 25 to 200, and more preferably 50 to 100. Line count of smaller than 10 causes a lot of unevenness in application at a high speed. Meanwhile, the line numbers of more than 300 causes easily clogging due to paper dust. The cell volume of the anilox roll is 10 to 100 cc, preferably 15 to 70 cc, and more preferably 30 to 60 cc. The cell volume of smaller than 10 cc makes it impossible to apply a required amount of chemicals. Meanwhile, the cell volume of more than 100 cc causes an increased amount of scattered chemicals.

Here, in the present invention, it is important that the chemicals can be stably applied in a chemicals applying process. Accordingly, the line count of the printing plate cylinder and that of the anilox roll are important, because they are related to stable operation. Furthermore, as a method for delivering chemicals stored in a storage tank to the anilox roll, an appropriate method such as a doctor chamber type or a touch roll type is employed. Examples which employ the respective type of the flexographic printing will be described in detail below.

(Example of Doctor Chamber Type)

An example in which the doctor chamber type flexographic printing is applied to the present invention will be described by particularly referring to FIGS. 15 to 20.

In this example, two flexographic printers 91A and 91B are used to apply the chemicals onto the front and rear surfaces of the multi-ply continuous sheet S2 or the respective continuous sheets S13 and S14.

In the respective printers 91A, 91B, doctor chambers 92A, 92B, which includes the chemicals therein are disposed to face rotatable anilox rolls 93A, 93B, and the chemicals are delivered from the doctor chambers 92A and 92B to the anilox rolls 93A and 93B. Further, printing plate cylinders 94A and 94B, which contact the anilox rolls 93A and 93B and contact also one surface of the multi-ply continuous sheet S2 or the like, are provided so as to be rotatable, and the chemicals are delivered from the anilox rolls 93A and 93B to the printing plate cylinders 94A and 94B. Then, pressure is applied to the multi-ply continuous sheet S2 or the like by the elastic rolls 95A and 95B with the printing plate cylinders 94A and 94B while the multi-ply continuous sheet S2 or the like is interposed therebetween so that the chemicals are applied from the printing plate cylinder 95A and 95B to the multi-ply continuous sheet S2 or the like.

The respective doctor chambers 92A and 92B are connected to a storage tank 98, which stores the chemicals L through a supply hose 96 and a return hose 97, so as to form a part of a chemicals circulation path (hereinafter, like an expression of "doctor chamber 91A (91B)", one of two is sometimes inserted in parentheses for describing the same configuration of the respective printers 91A and 91B). Furthermore, the storage tank 98 can be commonly used for the respective doctor chambers 92A and 92B. Although not illustrated, it is possible to provide a filtering device for paper dust or air included in the chemicals circulating the chemicals circulation path, as well as an inter tank and a pipe heater, which monitor and control temperature of the chemicals inside an application device such as the doctor chambers 92A and 92B and the like in order to keep viscosity of the chemicals to be stable.

The chemicals are pressed from the storage tank 98 into the doctor chamber 91A (91B) by a supply pump 99 through the supply hose 96, and the extrusion amount (flow rate) of the chemicals is adjusted by the opening and closing of an adjustment valve 100. Further, the chemicals are returned from the doctor chamber 91A (91B) to the storage tank 98 by a suction pump 101 through the return hose 97.

Further, the doctor chamber 91A (91B) includes a chamber portion 102, which stores the chemicals, and blades 103 and 104. The chamber portion 102 is connected to the supply hose 96 and the return hose 97 through connection portions 105 and 106, while an anilox roll 93A (93B)-side end of the chamber portion is open. Then, the chamber portion stores the chemicals L during the chemicals circulation through the respective hoses 96 and 97, and supplies the chemicals to the anilox roll 93A (93B). Meanwhile, the blades 103 and 104 are provided so as to abut against the anilox roll 93A (93B), and squeeze the chemicals L while being pressed against the anilox roll 93A (93B) so as to keep constant supply of the chemicals to the anilox roll 93A (93B).

Figure 17:
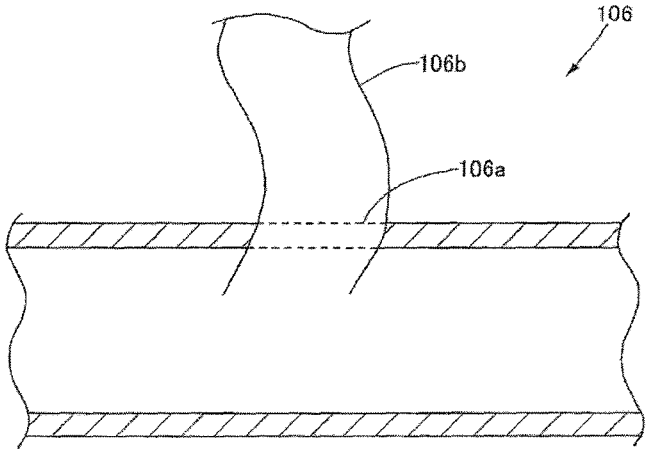
FIG. 17 is a schematic diagram illustrating an example of a derivation portion of a chemicals supply device.

Meanwhile, as illustrated in FIG. 17, an aperture 106*a* as an opening with a predetermined diameter is formed in an upper surface of a connection portion 106 between the chamber portion 102 and the return hose 97 used for a return path of the chemicals L, and the chemicals L inside the connection portion are exposed to open air through the aperture 106*a*. By doing so, even when the chemicals L are suctioned by the suction pump 101, it is possible to adjust internal pressure inside the chamber portion 102 to be around external air pressure. Accordingly, fluctuation in the internal pressure of the doctor chamber can be suppressed. Not being limited to this, it is possible to form the aperture 106*a* in for example, the upper surface of the chamber portion 102 as long as the fluctuation in the internal pressure of the chamber portion 102 is suppressed. The aperture 106*a* may be provided at the side surface as long as the aperture is positioned above the level of the chemicals L of the chamber portion 102.

Further, the aperture 106*a* is provided with a determining unit, which determines whether the chemicals are excessively supplied to the chamber portion 102. As the determining unit, for example, a transparent or translucent tubular member 106*b* can be exemplified, which extends upward from a hole portion 106*a*-side end as a lower end, and it is possible to visually determine whether the chemicals L flows into the tube 106*b* through the aperture during the chemicals L circulation. If the chemicals flow into the tube 106*b*, it can be known that the amount of the chemicals stored in the chamber portion 102 is excessive (the chemicals L are excessively supplied to the anilox roll 91A (91B)). Accordingly, a user, who visually recognizes the above situation of excessive supply of the chemicals, can solve such situation by adjusting the extrusion amount (flow rate) of the chemicals L through, for example, operation of the adjustment valve 100. Furthermore, since inside of the tube 106*b* is hollow and the upper end side thereof is exposed to open air, operational effect of the aperture 106*a* cannot be reversed with the above adjustment.

Furthermore, if the upper end (free end) of the tube 106*b* is provided so as to face downward, foreign matter such as paper dust can be prevented from contaminating inside through the aperture 106*b*. Alternatively, if an air filter is provided at the upper end of the tube 106*b* or at the aperture, foreign matter such as paper dust can be prevented from contaminating inside through the aperture 106*b*.

Furthermore, a situation of excessive supply of the chemicals L to the chamber portion 102 can be automatically c for notifying the user.

Figure 18:
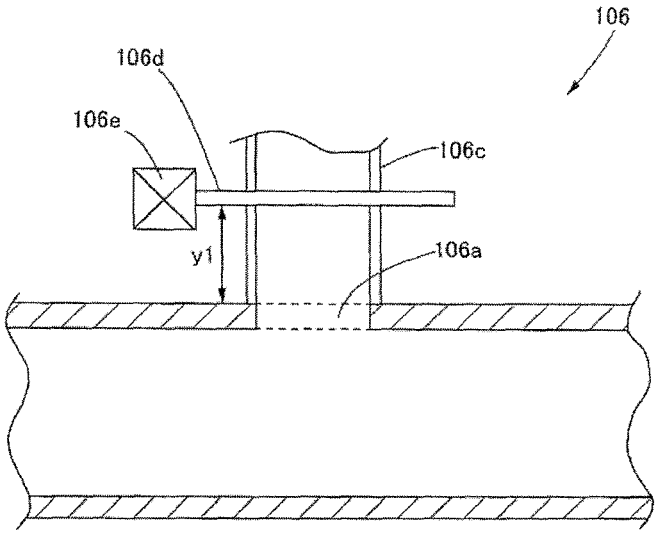
FIG. 18 is a schematic diagram illustrating another example of a derivation portion of the chemicals supply device.

In order to do this, in this example, as illustrated in FIG. 18, a sensor 106*d* is attached to a cylindrical portion 106*c* formed by extending the peripheral edge of the aperture 106*a* upward, and a notification unit notifies a result to the user after receiving signal from the sensor 106*d*.

The sensor 106*d* includes, for example, a light emitting element (not illustrated), which emits light toward a subject to be detected, and a light receiving element (not illustrated), which receives light from the subject to be detected, and detects whether the level of the chemicals L flowing into the cylindrical portion 106*c* reaches the level position (reference symbol y1 illustrated in FIG. 18), at which the sensor 106*d* is provided, on the basis of income of light received from reflected light by the light receiving element.

The notification unit 106*e* is, for example, a speaker or the like, and notifies the result to the user in terms of a voice when the sensor 106*d* detects that the level of the chemicals L flowing into the cylindrical portion 106*c* reaches the level position at which the sensor 106*d* is provided.

In this example, when the chemicals become excessive, the user may recognize it from the notification unit 106*e*, and can solve the situation of excessive supply of the chemicals by adjusting the extrusion amount (flow rate) of the chemicals L by the operation of the adjustment valve 100.

Figure 19:
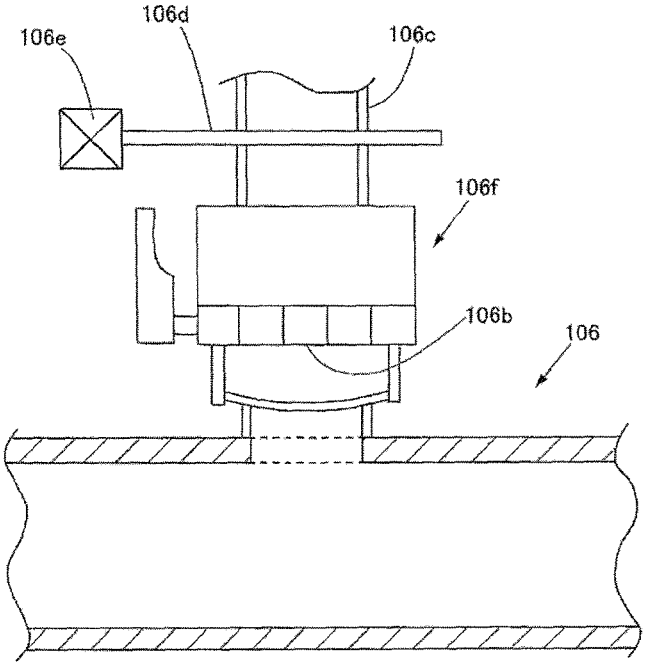
FIG. 19 is a schematic diagram illustrating further another example of a derivation portion of the chemicals supply device.
Figure 20:
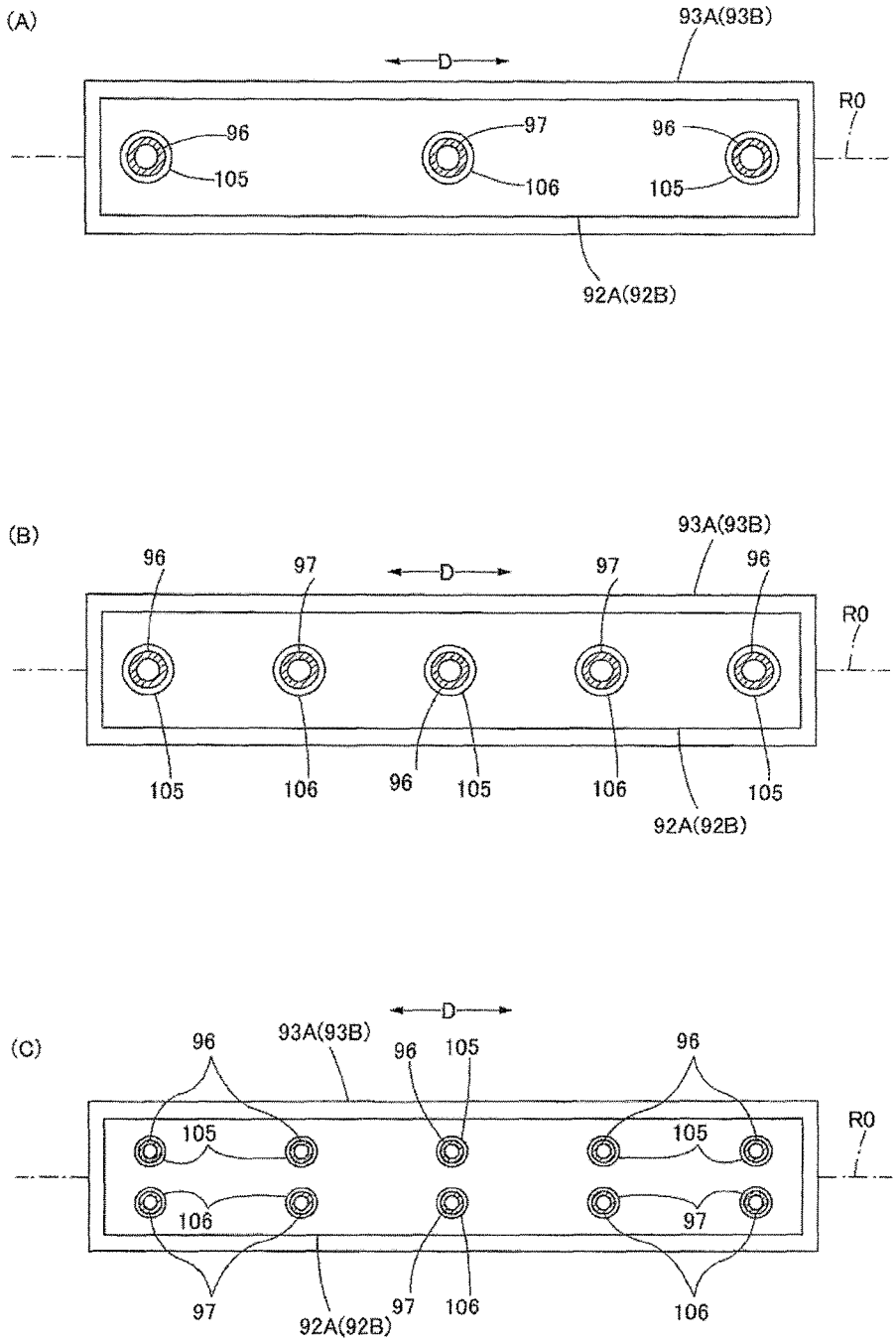
FIG. 20 is a diagram illustrating a structure of a doctor chamber used in the chemicals supply device, where

Besides to such an automatic determination stated above, as illustrated in FIG. 19, it is also possible to determine whether the chemicals L are excessively supplied to the chamber portion 102 by using an adjustment unit 106*f*, which is configured in a form of a needle valve with an orifice and a needle valve, and which is provided in the cylindrical portion 106*c* so as to adjust opening of a portion of the aperture 106*b* which is exposed to open air. In this way, by adjusting substantially the opening of the aperture 106*b* with the adjustment unit 106*f*, it is possible to appropriately adjust the opening of the aperture 106*b* according to the fluctuation of internal pressure of the chamber portion 102. Accordingly, when the sensor 103*e* detects a situation where the level position of the chemicals L flowing into the cylindrical portion 106*c* reaches the detection level position, this situation may be handled by adjusting the extrusion amount of the chemicals L, and the substantial opening of the aperture 106*b* is adjusted by the adjustment unit 106*f*. Thus, when the level position of the chemicals L flowing into the cylindrical portion 106*c* reaches the detection level position, in addition to the above adjustment of extrusion amount of the chemicals L, it is possible to handle in improving air releasing ability of the aperture 106*b* (through increase of area exposed to open air) by substantially adjusting of opening of the aperture 106*b* with the adjustment unit 106*f* so that the fluctuation of internal pressure of chamber portion 102 can be suppressed. Accordingly, it is possible to appropriately prevent spout of the chemicals from the chamber portion 102 and suction of the chemicals L on the anilox roll 93A (93B) toward the doctor chamber 92A (92B), which would be caused by the fluctuation of internal pressure, and hence to promote the chemicals L circulation.

Meanwhile, in the doctor chamber type flexographic printer, the anilox roll 93A (93B) is provided so as to abut against the blades 103 and 104 of the doctor chamber 92A (92B), and the chemicals L supplied from the opening of the chamber portion 102 of the doctor chamber 92A (92B) are absorbed to the peripheral surface thereof.

The printing plate cylinder 94A (94B) is formed rotatably so that the peripheral surface thereof is formed of a resin material such as rubber in a columnar shape, while the peripheral surfaces of the left and right ends thereof (at the points P1 and P2 illustrated in FIG. 4) abut against the peripheral surfaces of (the multi-ply continuous sheet S2 wound on) the anilox roll 93A (93B) and the elastic roll 95A (95B).

The printing plate cylinder 94A (94B) rotates in the direction r2 along with the rotation of the elastic roll 95A (95B) in the direction r1 so as to rotate the anilox roll 93A (93B) abutting against the right end thereof in the direction r1. The printing plate cylinder 94A (94B) acquires the chemicals L absorbed to the peripheral surface of the anilox roll 93A (93B) at the point P2, and conveys the chemicals to the point P1 by the rotation in the direction r2 so as to transfer the chemicals onto the multi-ply continuous sheet S2 or the like. Even when the chemicals L absorbed by the anilox roll 93A (93B) non-uniformly remains on the peripheral surface of the anilox roll 93A (93B) in a laminar state, the chemicals L may be uniformly transferred to the multi-ply continuous sheet S2 by conveying the chemicals to the peripheral surface of the printing plate cylinder 94A (94B).

The elastic roll 95A (95B) is a columnar member that is provided so as to be adjacent to the printing plate cylinder 94A (94B), to rotate by a driving force applied from a motor or the like (not illustrated), and to hold the multi-ply continuous sheet S2 at the peripheral surface thereof. For this reason, when the elastic roll 95A (95B) rotates in the direction r1, the elastic roll winds the multi-ply continuous sheet S2 or the like on the peripheral surface thereof, while the printing plate cylinder 94A (94B) and the anilox roll 93A (93B) are rotated so that the chemicals L are transferred from the printing plate cylinder 94A (94B) just when the chemicals are conveyed to the point P1.

Figure 16:
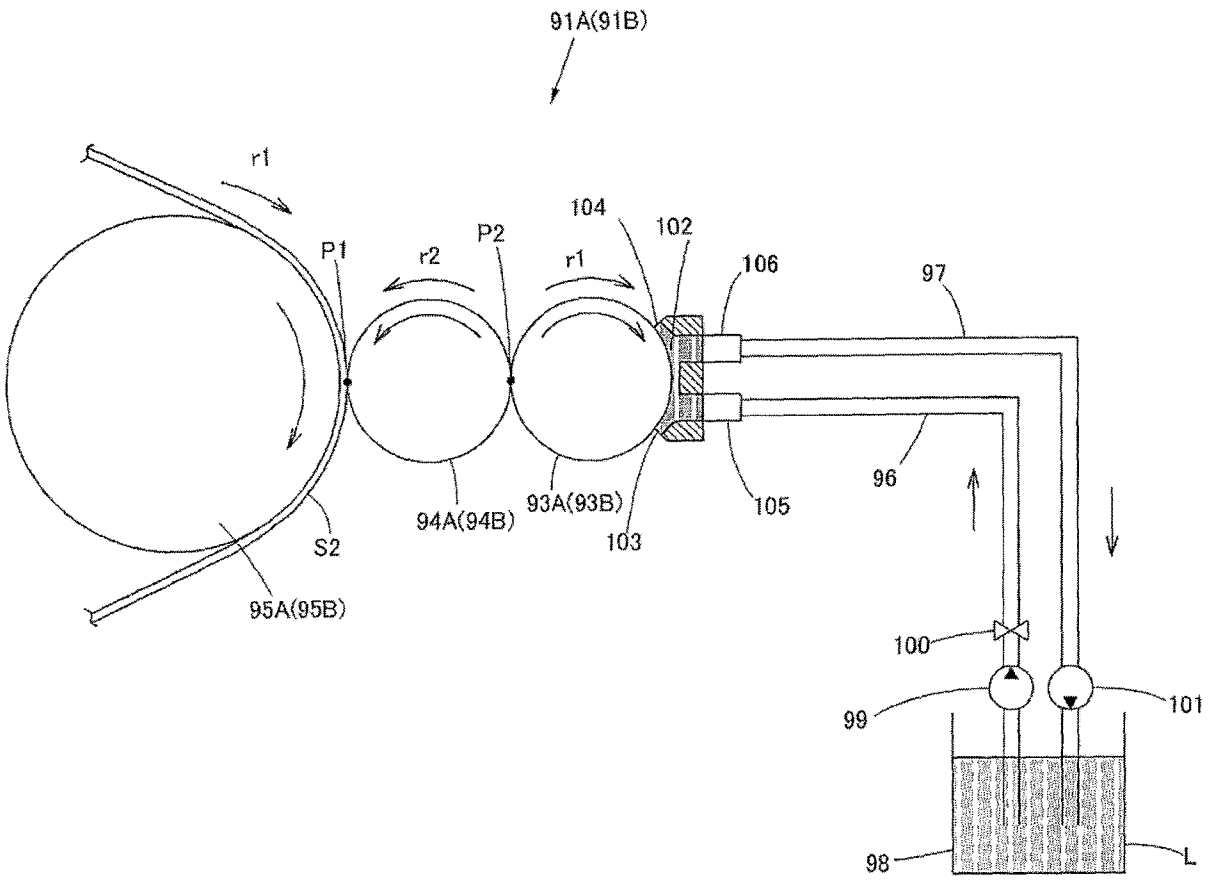
FIG. 16 is a schematic diagram illustrating an example of a doctor chamber type flexographic printing.

Furthermore, the rotation direction of the elastic roll 95A (95B) is set as the direction r1 in FIG. 16, but may be set as the direction r2. In this case, the anilox roll 93A (93B) and printing plate cylinder 94A (94B) rotate in a direction opposite to the direction of FIG. 16 (that is, the anilox roll 93A (93B): the direction r2 and the printing plate cylinder 94A (94B): the direction r1).

Here, in the example illustrated in FIG. 16, only one supply hose 96 and only one return hose 97 are connected to the chamber portion 102. However, in order to uniformly diffuse the chemicals L in the width direction inside the chamber portion 102, configurations illustrated in FIGS. 20(A) to 20(C) may be exemplified. FIG. 20(A) illustrates a configuration example in which the return hose 97 is connected to the center portion and the supply hoses 96 are respectively connected to the vicinities of the left and right ends in the width direction D of the doctor chamber 92A (92B) of which the outer frame is formed in a wide rectangular shape along the wide anilox roll 93A (93B) rotating about the rotation shaft R0. FIG. 20(B) illustrates a configuration example in which three supply hoses 96 and two return hoses 97 are alternately connected in the width direction D at the same interval. FIG. 20(C) illustrates a configuration example in which the supply hoses 96 are respectively connected to a plurality of positions at the upper side of the chamber portion 102 and the return hoses 97 are respectively connected to a plurality of positions at the lower side thereof.

(Example of Two-roll Transfer Type)

Figure 21:
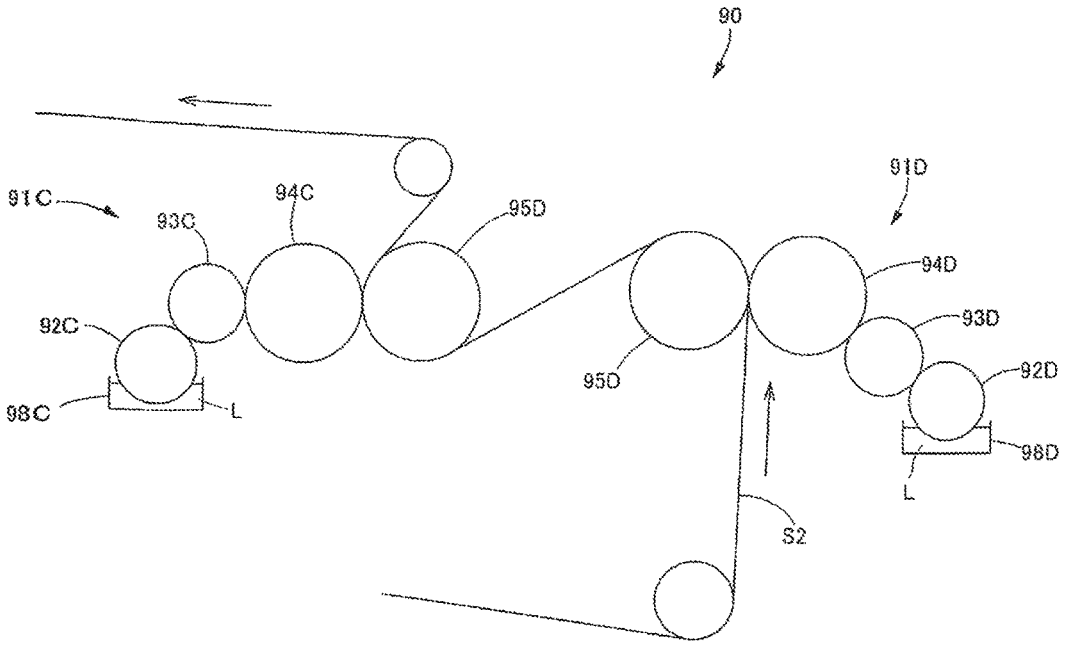
FIG. 21 is a schematic diagram illustrating an example of a double roll type flexographic printing system.

Subsequently, an example of two-roll transfer type flexographic printing will be described by referring to FIG. 21. Also in this example, two flexographic printers 91C and 91D are used to apply the chemicals L onto the front and rear surfaces of the multi-ply continuous sheet S2 or the like. In the respective printers 91C, 91D, dipping rolls 92C and 92D as rotatable squeezing rolls are dipped into chemicals tanks 98C, 98D which store the chemicals L therein, and the dipping rolls 92C, 92D contact anilox rolls 93C, 93D which are rotatable outside the chemicals tanks 98C and 98D. Accordingly, the chemicals amount is appropriately adjusted, and the thus adjusted chemicals are delivered to the anilox rolls 93C and 93D. This is called a two-roll transfer type in that the dipping rolls 92C, 92D are used to deliver the chemicals L to the anilox rolls 93C, 93D. Here, the dipping rolls 92C and 92D function to absorb the chemicals L from the chemicals tanks 98C, 98D and also to control excessive chemicals such that they are not directly delivered to the anilox rolls 93C, 93D as they are.

The anilox rolls 93C and 93D contact the printing plate cylinders 94C and 94D, and the chemicals L transferred from the dipping rolls 92C and 92D are delivered to the printing plate cylinders 94C and 94D. The printing plate cylinders 94C and 94D are provided rotatably and contact the anilox rolls 93C and 93D while they contact one surface of the multi-ply continuous sheet S2 or the like. Then, pressure is applied to the multi-ply continuous sheet S2 or the like by the printing plate cylinders 94A and 94B with the elastic rolls 95C and 95D, while the multi-ply continuous sheet S2 or the like is interposed therebetween so that the chemicals L are applied to the multi-ply continuous sheet S2 or the like.

In the two-roll transfer type, the anilox rolls 93C and 93D may be provided with a doctor blade. In this case, there is a merit that the chemicals L can be applied uniformly and scattering of the chemicals L from the anilox rolls 93C and 93D can be prevented. On the contrary, in application at a high speed, there is a demerit that the doctor blade should be maintained or replaced many times.

Furthermore, although not illustrated, the chemicals tanks 98C and 98D may be provided with a filtering device for paper dust or air included in the chemicals, a pipe heater which monitors and controls the temperature of the chemicals to stabilize the viscosity of the chemicals, a sensor which monitors a moisture regain and an unevenness in the paper surface direction and is configured as an infrared detector for managing an amount of applied chemicals by the moisture regain of the multi-ply continuous sheet S2 or the like in the width direction, and the like.

(Example of One-roll Transfer Type)

Subsequently, an example of one-roll transfer type flexographic printing will be described. In this example, the dipping roll is omitted from the above-described two-roll transfer type (the drawing thereof is not illustrated). In this case, the anilox rolls are respectively dipped into the chemicals tanks while they are provided rotatably. Further, these anilox rolls are provided with doctor blades which scrape the chemicals on the surfaces of the anilox rolls. The flexographic one-roll transfer type has an advantage that the maintenance is comparatively easy or an advantage that the abrasion of the blade or the contamination of the foreign matter such as paper dust inside the chemicals may be easily checked visually.

[Spray Application]

Figure 22:
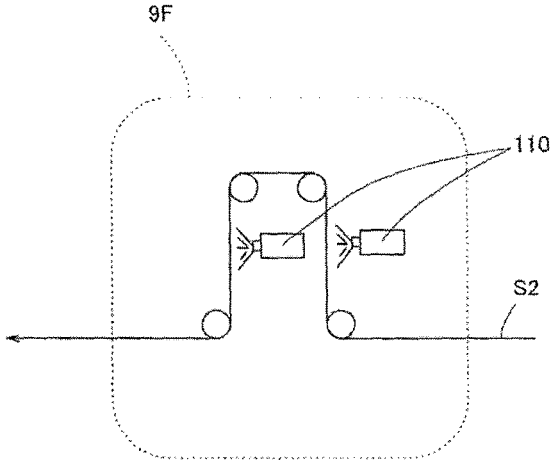
FIG. 22 is a schematic diagram illustrating an example of chemicals application using a chemicals spraying device.
Figure 23:
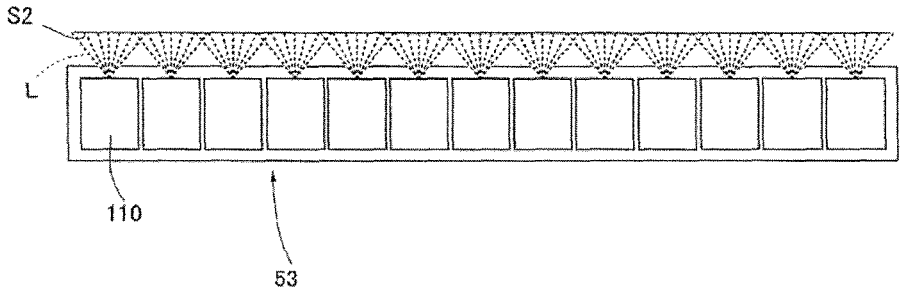
FIG. 23 is another schematic diagram illustrating the example of the chemicals application using the chemicals spraying device.

An example in which spray application devices 110, 110 are used for the chemicals applying process (the chemicals applying unit) 53 will be described by referring to FIGS. 22 to 26. In the embodiment, as illustrated in FIG. 22, the spray application devices 110 and 110 are provided so as to apply the chemicals onto the front and rear surfaces of the multi-ply continuous sheet S2 or the like. In order to realize this, as illustrated in FIG. 10, a configuration in which a paper run is designed so that the chemicals are sprayed to the front and rear surfaces of the multi-ply continuous sheet S2 or the like from the lateral side, a configuration in which the chemicals are sprayed to the front and rear surfaces of the multi-ply continuous sheet S2 or the like from the upper and lower sides, and a configuration in which a paper run is designed so that the chemicals are sprayed to the front and rear surfaces from the upper side may be exemplified. Of course, a configuration may be employed in which the multi-ply continuous sheet S2 or the like is once ply-separated, the chemicals are sprayed to the respective continuous sheets, and the respective continuous sheets are multi-plied again.

Furthermore, since the chemicals may easily scatter toward the periphery in the spray application, it is desirable to provide a hood 53F, which covers the chemicals applying unit 53, so as to prevent influences on the other processes.

Specifically, the spray application may employ a nozzle spray type, a rotor dampening spraying type, or the like. As a spray nozzle in the nozzle spray type, exemplified are a hollow conical nozzle for spraying chemicals in an annular shape, a full-conical nozzle for spraying chemicals in a circular shape, a full-pyramid nozzle for spraying chemicals in a square shape, a full-rectangular nozzle, a fan-like nozzle, and the like. In order to uniformly spray the chemicals with respect to the width direction of the multi-ply-sheet from the secondary paper roll, nozzle diameter, number of nozzles, nozzle arrangement pattern, and number of arranged nozzles may be appropriately selected. Alternatively, spraying distance, spraying pressure, spraying angle, or concentration and the viscosity of the spraying liquid may be appropriately selected.

Further, as an atomizing method by a nozzle spraying device, two kinds of types, that is, a one-fluid type or a two-fluid type may be selected for use. Among these types: in one-fluid spraying type, mist drips are sprayed from a nozzle by directly pressurizing chemicals to be sprayed using compressed air; or mist drips are sprayed from a microscopic hole formed on the side surface of the nozzle in the vicinity of an ejection port. Further, as the two-fluid spraying type, exemplified are: an internal mixing type where inside of the nozzle, compressed air is mixed with liquid to be sprayed and the mixture is atomized for spraying; an external mixing type where outside of the nozzle, sprayed compressed air is mixed with sprayed liquid so as to be atomized; and a collision type where atomized mist drip particles are collided mutually for further homogenizing and atomizing; and the like.

Meanwhile, in a rotor dampening spraying type, a spraying liquid is discharged onto a disk rotating at a high speed and atomized so as to be fine mist drip particles by a centrifugal force of the disk. Here, a diameter of the mist drip particle is controlled by changing a rotation speed of the disk and an amount of sprayed liquid (an amount of applied liquid) is controlled by changing an amount of liquid discharged onto the disk. A rotor dampening application device has advantages that a small amount of the sprayed liquid can be uniformly applied onto a surface of paper to be pigment-applied, while scattering of the mist drip particles is suppressed and a spraying speed, a diameter of mist drip particle and the like can be easily controlled.

In order to uniformly spray the chemicals to the surface of the multi-ply continuous sheet S2 or the like, it is desirable to micronize the diameter of the mist drip particle of the chemicals as small as possible. However, when the mist drips are micronized too much, the mist drip particles are washed away by bounce of the sprayed air or accompanied air on the surface of the multi-ply continuous sheet S2 or the like, and hence mist drips are unlikely to adhere to the surface of the multi-ply continuous sheet S2 or the like. For this reason, in a case of spray application, a spraying distance, a spraying pressure, a spraying angle, and a spraying speed can be adjusted so that a diameter of the mist drop particle can be adapted to meet application conditions. Additionally, in a case of the two-fluid type, a mixing ratio of the chemicals to be sprayed to compressed air, concentration or viscosity of the chemicals, and the like can be appropriately adjusted too. Further, if influence by the accompanied air is large in spraying, in order to remove the accompanied air, a suctioning device, a baffle (baffle plate), the above-described hood, or a charging electrode (an electrostatic spraying), which applies a high voltage to a tip of a spraying nozzle to charge mist drip particles for improving ability of adhering to paper to be applied with pigment.

The mist drip particles, which are not applied onto the surface of the multi-ply-sheet from the secondary paper roll and float as mist can be collected for re-spraying.

Figure 24:
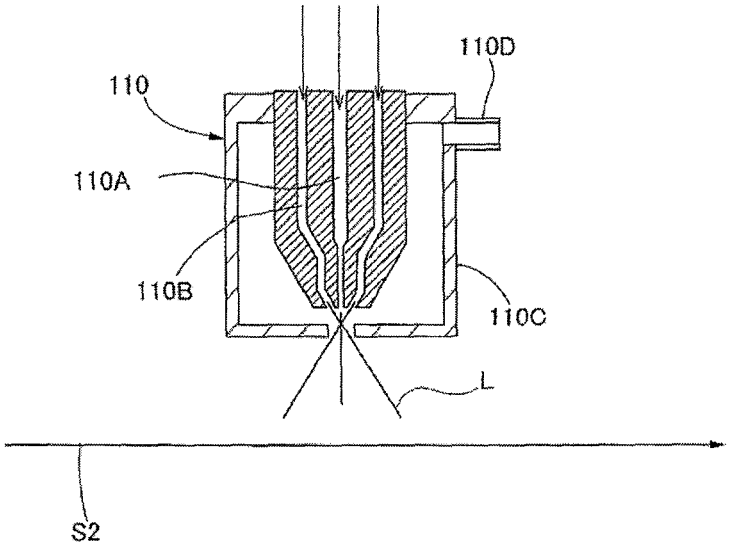
FIG. 24 is a schematic diagram illustrating an example of a chemicals spraying device.

FIG. 24 illustrates a chemicals spraying device 110 of a nozzle spray type, that is, a two-fluid type. In this device 110, a chemicals passage 110A is formed at the center thereof and an air passage 110B is formed at the periphery thereof. Accordingly, the chemicals L ejected from the tip of the chemicals passage 110A are atomized by air ejected from the air passage 110B, and the chemicals L are sprayed in a substantially conical shape. An external protection casing 110C is provided so as to protect the nozzle against paper dust or the like and so as to clean the nozzle by air passing through a purging air passage if necessary. One or plural chemicals spraying device 110 of this kind can be provided and in case of plural devices, they are spaced in the width direction of the multi-ply continuous sheet S2 at intervals.

Figure 25:
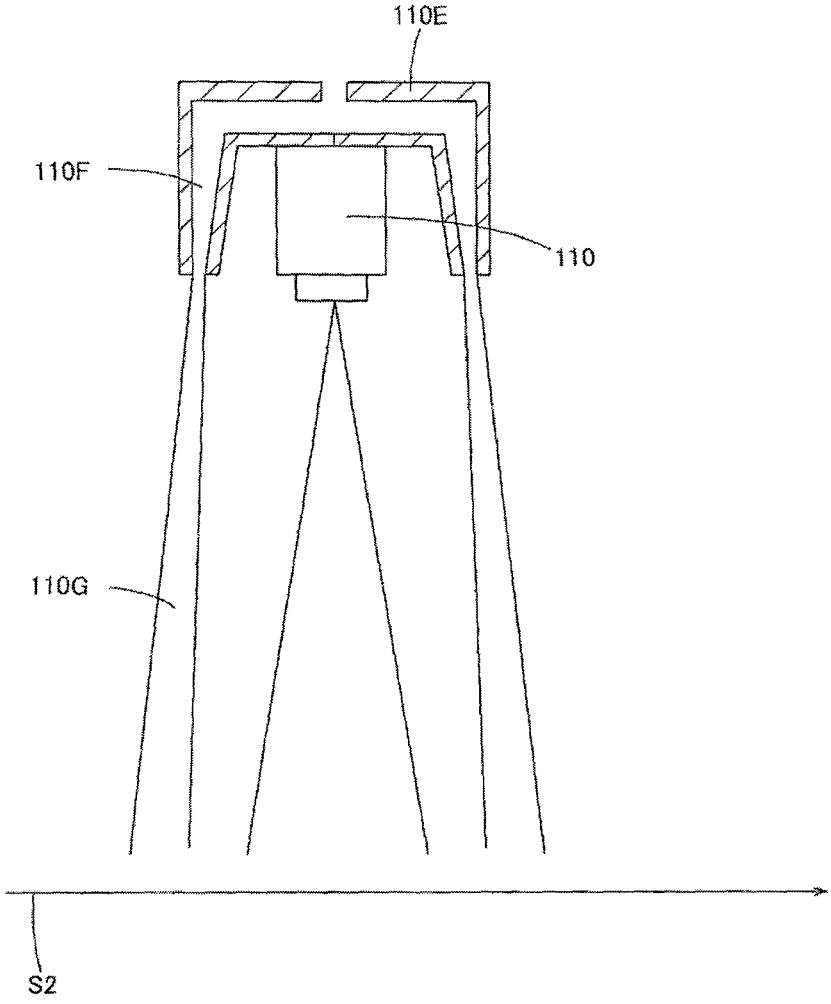
FIG. 25 is a schematic diagram illustrating another example of a chemicals spraying device.

As described above, since the mist drips are washed away by scattered chemicals or the accompanied air on the surface of the multi-ply continuous sheet, the mist drips are unlikely to adhere to the surface of the multi-ply continuous sheet S2 or the like. For this reason, as illustrated in FIG. 25, the chemicals may be appropriately applied onto the multi-ply continuous sheet S2 or the like by surrounding the chemicals sprayed from the chemicals spraying unit (the spraying nozzle) by air 110G ejected from an air supply path formed in a casing 153E from the periphery of the chemicals spraying unit (the spraying nozzle) of the one-fluid type or the two-fluid type.

Figure 26:
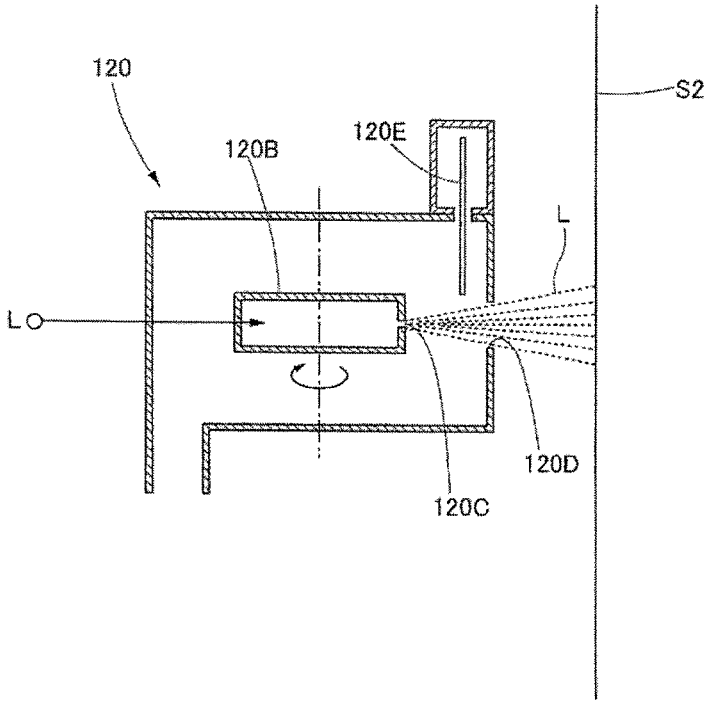
FIG. 26 is a schematic diagram of an example of a rotor dampening type chemicals spraying device.

FIG. 26 is an example of a rotor dampening spraying device 120. In the rotor dampening spraying device 120, a fluid chamber 120B with an ejection portion 120C rotates at a high speed so as to deliver chemicals L into the fluid chamber 120B, and the chemicals inside the fluid chamber are discharged from the ejection portion 120C by a centrifugal force so that the chemicals are atomized. A diameter of a mist drip particle is controlled by changing a rotation speed of the fluid chamber 120B, and an amount of sprayed liquid (amount of applied liquid) is controlled by changing an amount of charged liquid to the fluid chamber. The rotor dampening spraying device has an advantage that a small amount of the sprayed liquid can be uniformly applied onto the surface of a sheet while scattering of mist drips is suppressed and a spraying speed or the diameter of the mist drop particle can be easily controlled.

In the rotor dampening device 120 of the example illustrated in the drawing, it is preferable that a shutter 120E for opening or closing an ejection port 120D is provided, and due to this shutter 120E, execution of spraying can be controlled by the opening or closing thereof.

[Inkjet Printing]

Figure 27:
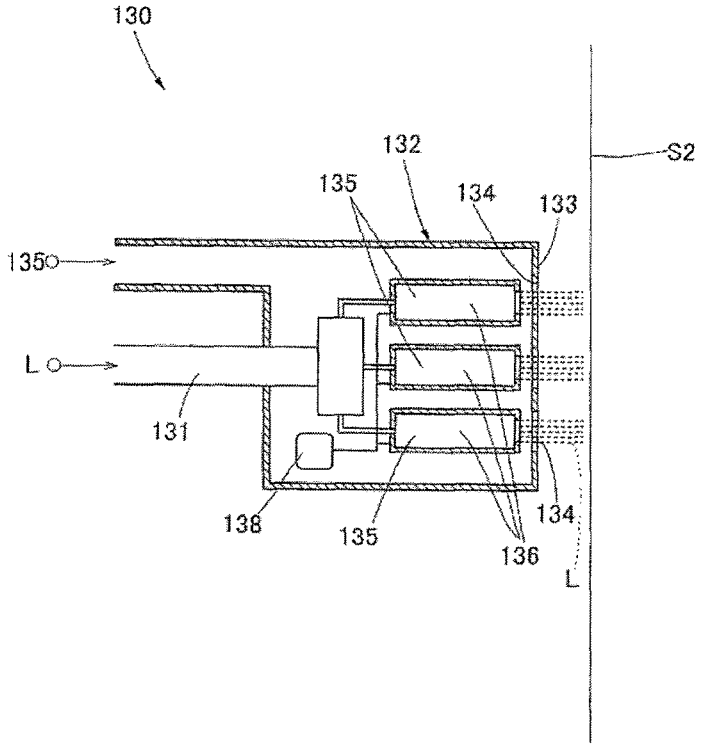
FIG. 27 is a schematic diagram illustrating an example of chemicals application using an inkjet type printing system.
Figure 28:
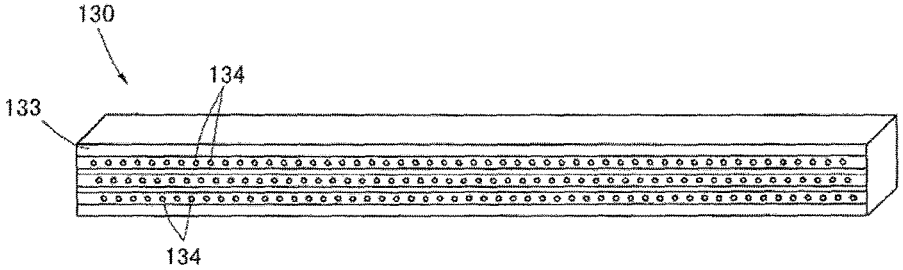
FIG. 28 is a schematic diagram illustrating an ink head of the inkjet type printing system.

An example in which an inkjet printer 130 is used in the chemicals applying process (the chemicals applying unit) 53 will be described by referring to FIGS. 27 and 28.

The inkjet printer 130 of the embodiment has a configuration in which a tank (not illustrated) storing the chemicals L is connected to an inkjet head 132 through a supply path 131, and water-based chemicals are supplied from the tank to the inkjet head 132 by a supply pump (not illustrated).

In a portion of the inkjet head 132 facing the multi-ply continuous sheet S2 or the like as a material to be applied, a nozzle plate 133 with a plurality of nozzle holes 134 arranged in a straight line is disposed so as to correspond to at least the width of the multi-ply continuous sheet S2 or the like.

Here, a gap from the nozzle holes 134 to the multi-ply continuous sheet S2 or the like is preferably 1 to 10 mm and more preferably 1 to 3 mm. In the inkjet printing type, since an amount of liquid droplets ejected from each nozzle hole 134 is extremely small, the liquid droplets tend to be influenced by surrounding airflow. However, when the gap is 1 to 10 mm and more preferably 1 to 3 mm, such influence is remarkably reduced. In a common full color printer, a gap between a paper sheet and a nozzle is 1 to 1.5 mm. Since human eye is sensitive to a difference in brightness or gradation, accuracy of dot position needs to be within several μmeters in order to obtain a sufficient color expression by subtractive color mixing of four to six colors. However, in application of water-based chemicals of the present invention, it is possible to obtain a sufficiently uniform application quality even with accuracy of the dot position of 100 μm or less.

Then, a plurality of ejection units 135 are disposed so as to correspond to the respective nozzle holes inside the inkjet head 132, and each ejection unit 135 includes a fluid chamber 136, which temporarily stores the water-based chemicals to be injected from the nozzle hole 134; a vibration plate 137, which is provided so as to face the nozzle plate 133 through the fluid chamber 136 interposed therebetween; and a piezoelectric element (not illustrated), which is disposed outside the fluid chamber 136 so as to abut against the vibration plate 137.

A control device 138 is connected to the piezoelectric element through a wiring, and a voltage is applied from the control device 138 to the piezoelectric element at a predetermined interval.

By such a structure, the water-based chemicals supplied from the tank to the inkjet head 132 are delivered into the fluid chamber 136 disposed so as to correspond to each nozzle hole 134. Then, when the control device 138 applies a voltage to the piezoelectric element if necessary, the water-based chemicals are sprayed from the respective nozzle holes 134 at the same time. Accordingly, the chemicals are applied to one surface of the multi-ply continuous sheet S2 or the like in the entire width thereof.

Further, pressurized air 135 is delivered into the inkjet head 132 of the embodiment, and the liquid droplets ejected from the ejection unit 135 are directed toward the sheet S3 by the pressurized air from the nozzle hole 134. Accordingly, blocking of paper dust in the nozzle hole can be prevented.

Furthermore, in the above-described embodiment, a configuration, which uses an On Demand type piezoelectric element as an inkjet type, has been described, but a thermal jet type may be employed. Further, a continuous type ejection device capable of continuously ejecting the chemicals may be employed instead of the On Demand type. However, the On Demand type based on the electronic control is desirable, because an amount of applied liquid can be adjusted in the width direction and in the flow direction in the On Demand type.

Here, in the embodiment, as desirable conditions in a case of applying the chemicals by employing the inkjet printing type, there are particle speed of the ink droplet from the nozzle hole of about 5 to 20 m/second and volume of one ink droplet of 5 to 50 pl.

Further, it is desirable to apply the ink droplet at intervals of 20 to 200 μm in the flow direction and the width direction. Thus, uniform application can be attained even if there is increase and decrease of an amount of applied chemicals. The nozzle interval in the width direction is set to be 128 to 1080 dpi (5 to 42 lines/mm, 128 dpi×1 stage to 360 dpi×3 stages). As an example, when a processing speed is 250 m/minute, under assumption of a particle speed of an ink droplet of 10 m/second, a volume of one ink droplet of 10 pl, a nozzle interval in the width direction is 1080 dpi, inkjet ejection frequency is about $5\times10^4$ dots/second/line.

[Curtain Coating]

An example in which a curtain coater 150 is used as a chemicals applying process (chemicals applying unit) 53 will be described. As the curtain coater 150, for example, a conventional and known curtain coater illustrated in FIG. 29 may be used. Furthermore, in a case of applying front and rear surfaces of a multi-ply-sheet S2 or the like, it is necessary to design paper running such that the front and rear surfaces of the multi-ply-sheet S2 are positioned at the upper side, because curtain film of chemicals is hanged by the curtain coating.

Figure 29:
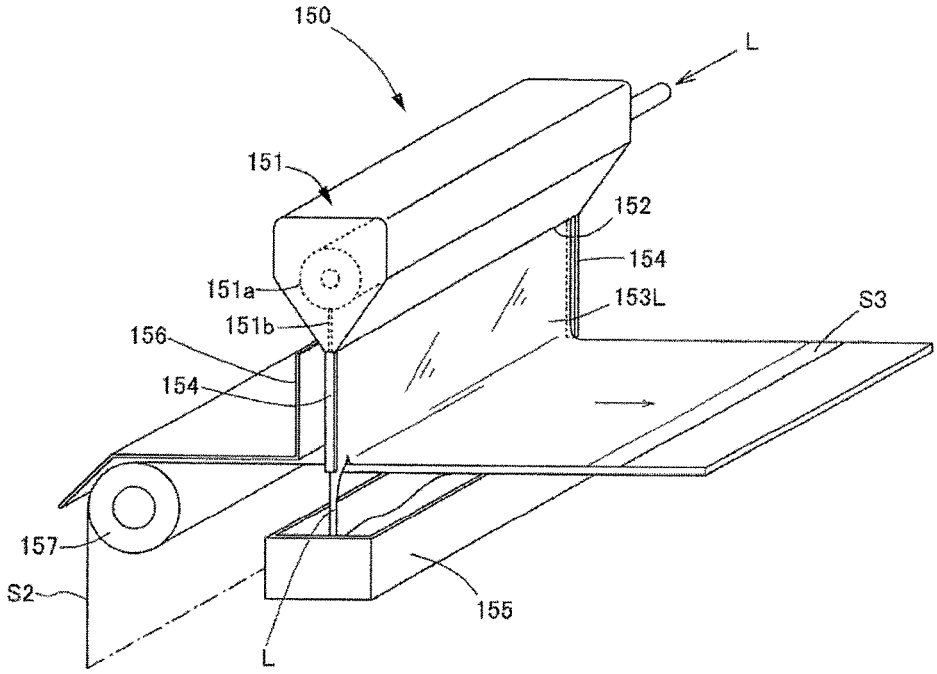
FIG. 29 is a schematic diagram illustrating a curtain coater.

In the curtain coater 150 illustrated in FIG. 29, the previously prepared chemicals L are sent from a chemicals storage tank to a coater head 151 by a liquid supply pump or the like. Inside of the coater head 151 includes a manifold 151*a* and a slit 151*b*, which are precisely finished. When supplied quasi-adhesive is charged into the manifold 151*a* and is further sent to the slit 151*b*, influence of dynamic pressure caused by liquid sent with a liquid supply pump is reduced in a narrow gap through which the quasi-adhesive passes. Accordingly, pressure distribution in the width direction becomes uniform, and the quasi-adhesive flows out of a lip 152, so that a vertical curtain film 153L is formed.

The vertical curtain film 153L with uniform profile in the width direction contacts the multi-ply-sheet S2 from the secondary paper roll or the like, which runs continuously, and is applied onto the multi-ply-sheet S2 from the secondary paper roll or the like. Here, edge guides 154 are provided so as not to exceed the width of the coater head 151 and so as to exceed the width of the multi-ply-sheet S4 from the secondary paper roll or the like, and the vertical curtain film is formed so as to exceed the width of the multi-ply-sheet S4 from the secondary paper roll or the like. The vertical curtain film 153L is formed so as to exceed the width of the multi-ply-sheet S2 from the secondary paper roll in order to prevent thick application of the chemicals L at both ends of the vertical curtain film 153L. The chemicals L which flow down while exceeding the width of the multi-ply-sheet S4 from the secondary paper roll or the like is collected to a liquid receiving tank 155 and is returned to the chemicals storage tank for re-application. Further, this unit is configured such that even when the application is stopped due to paper breakage of the single-sheet S2 from the secondary paper roll or the like, the chemicals L can be collected to the liquid receiving tank 155.

A contact portion (hereinafter, referred to as an application portion) of the vertical curtain film 153L to the multi-ply-sheet S2 from the secondary paper roll or the like, which runs continuously, is provided with a wind shielding plate 156, which shields air flow accompanied by the multi-ply-sheet S2 from the secondary paper roll or the like so that the vertical curtain film 153L flows to the multi-ply-sheet S2 from the secondary paper roll or the like without being disturbed by the air flow or the like around the curtain. Further, the conveying direction of the multi-ply-sheet S2 from the secondary paper roll or the like is changed by a roll 157 immediately before the application portion so as to minimize influence on the application portion by companied air with the multi-ply-sheet S2 from the secondary paper roll or the like. Furthermore, in order to perform the stable application, a certain height is required from the multi-ply-sheet S2 from the secondary paper roll or the like to the lower outflow portion of the coater head 151, but the height appropriate for the stable application is 60 to 300 mm, desirably 100 to 250 mm, and more desirably 120 to 180 mm.

BRIEF DESCRIPTION OF NUMERALS

X1 paper manufacturing machine
JR primary paper roll (jumbo roll)
W wet paper
S1 dry base paper (single-sheet from a primary paper roll)
31 head box
32 wire part
32*w* wire
333 press part
33F felt
34, 35 dewatering roll
36 Yankee dryer
37 doctor blade
38 winding unit
39 winding drum
X2 ply machine
R secondary paper roll applied with chemicals
S11, S12, S13 single-sheet from a primary paper roll
S2, S3 multi-ply continuous sheet
S4 multi-ply-sheet from a secondary paper roll
51 multi-ply forming unit
53 chemicals applying unit (chemicals applying process)
53A, 53B chemicals applying device
56 winding unit
56A, 56B winding drum
52 calender portion (smoothing process)
55 slitting unit
58 re-multi-ply forming unit
X3 winder
10 toilet roll
10R log
11 paper core
11L long paper core
12 paper core base paper
12A paper core paper roll
13 glue unit
14 core winder
15 core shaft
16 slitter unit
54 ply bonding unit (ply bonding process)
70 perforation line applying unit
71 perforation roll
72 receiving roll
75 rewinding unit
76 round blade
L1 toilet roll width
X4 log accumulator
X5 log cutter
S toilet roll products
20 outer film
10 toilet roll
S5 toilet paper
20 outer (packing) film
25 handle
60 embossing unit
61 embossing roll
62 nipping roll

The invention claimed is:

1. A method for manufacturing toilet roll products applied with chemicals comprising:

continuously manufacturing a secondary paper roll for the toilet roll products from a plurality of primary paper rolls using a ply machine, wherein said plurality of primary paper rolls have been manufactured and wound by a paper manufacturing machine, wherein the ply machine includes a multi-ply forming unit, which performs multi-ply forming on single-continuous sheets reeled out from said plurality of primary paper rolls so as to form a multi-ply continuous sheet, a chemicals applying unit, which applies chemicals comprising at least one polyol to the multi-ply continuous sheet after it leaves the multi-ply forming unit, and a winding unit, which winds the multi-ply continuous sheet applied with the chemicals so as to form the secondary paper roll, said secondary paper roll having a width plural times or more than a width of a toilet roll;

conveying the secondary paper roll for the toilet roll products to a winder and setting it in a paper roll support portion of said winder, wherein the chemicals spread and are absorbed by the multi-ply continuous sheet while it is being conveyed to and set in the paper roll support portion of the winder causing stretching of the multi-ply continuous sheet resulting from a stretching of its crepe; reeling out the multi-ply-sheet from the secondary paper roll that has been applied with the chemicals; forming perforation lines on the multi-ply continuous sheet reeled out from the secondary paper roll in the width direction of the multi-ply continuous sheet from the secondary paper roll at a predetermined interval; and after that, rewinding the multi-ply continuous sheet to a winding diameter of the toilet roll, so as to manufacture a log for the toilet roll;

conveying the log manufactured in the winder to a log cutter and cutting the log into the width of the toilet roll using a log cutter so as to provide individual toilet rolls; and putting one or more of said individual toilet rolls in a product package so as to obtain the toilet roll products.

2. The method for manufacturing the toilet roll products applied with the chemicals according to claim 1, wherein the ply machine includes an embossing unit, and the embossing unit performs single embossing on the multi-ply continuous sheet after or before application of the chemicals, where the single embossed multi-ply continuous sheet is not separated into its single sheets before forming the toilet roll products.

3. The method for manufacturing the toilet roll products applied with the chemicals according to claim 1, wherein the ply machine includes an embossing unit which is provided before the multi-ply forming unit, embosses the single continuous sheets from one or more of said plurality of the primary paper rolls, and after that, the multi-ply forming unit performs multi-ply forming on the embossed single continuous sheets from the plurality of primary paper rolls.

4. The method for manufacturing the toilet roll products applied with the chemicals according to claim 1, wherein the ply machine includes the multi-ply forming unit, a ply-separating unit, an embossing unit, and a re-multi-ply forming unit arranged in this order, and wherein the multi-ply forming unit performs multi-ply forming on single continuous sheets reeled out from said plurality of primary paper rolls to form the multi-ply continuous sheet, and the ply-separating unit then ply-separates the multi-ply continuous sheet into its constituent single continuous sheets, and at least one of which is then embossed by the embossing unit.

5. The method for manufacturing the toilet roll products applied with the chemicals according to claim 1, wherein the winder includes an embossing unit, and the embossing unit performs single embossing on the multi-ply continuous sheet from the secondary paper roll, which has been reeled out from the secondary paper roll and applied with the chemicals, and where the single embossed multi-ply continuous sheet is not separated into its single sheets before forming the toilet roll products.

6. The method for manufacturing the toilet roll products applied with the chemicals according to claim 1, wherein the ply machine includes a slitting unit positioned between the chemicals applying unit and the winding unit, and wherein the slitting unit slits the multi-ply continuous sheet reeled out from the secondary paper roll applied with the chemicals into the width plural times or more than the width of the toilet roll and after that, the winding unit winds the multi-ply continuous sheets, which have been cut into the width plural times or more than the width of the toilet roll.

7. The method for manufacturing the toilet roll products applied with the chemicals according to claim 1, wherein the ply machine includes a ply bonding unit, which is provided after the multi-ply forming unit, and performs linear ply bonding on the multi-ply continuous sheet so as to prevent ply-separating, and the ply bonding unit performs ply bonding at intervals that correspond to the width of the toilet roll.

8. The method for manufacturing the toilet roll products applied with chemicals according to claim 1, wherein the winder includes an embossing unit, which is positioned before the perforation line applying unit, and performs single embossing on the multi-ply continuous sheet applied with the chemicals and reeled out from the secondary paper roll.

9. The method for manufacturing toilet roll products applied with chemicals according to claim 1, wherein the winder includes a ply-separating unit, an embossing unit, and a re-multi-ply forming unit, which are positioned in this order and before the perforation line applying unit, and wherein the ply-separating unit ply-separates the multi-ply continuous sheet applied with the chemicals reeled out from the secondary paper roll, into its constituent single continuous sheets, the embossing unit then embosses one or more of the ply-separated single continuous sheets, and then the re-multi-ply forming unit performs re-multi-ply forming on the single continuous sheets to produce a second multi-ply continuous sheet.

10. The method for manufacturing the toilet roll products applied with the chemicals according to claim 4, wherein the ply machine includes a ply bonding unit which is positioned after the re-multi-ply forming unit and performs linear ply bonding on the multi-ply continuous sheet so as to prevent ply-separating, and the ply bonding unit performs ply bonding at intervals corresponding to the width of the toilet roll.

11. A method for manufacturing toilet roll products applied with chemicals, comprising:

continuously manufacturing a secondary paper roll for the toilet roll products from a primary paper roll using a ply machine, wherein said primary paper roll has been manufactured and wound by a paper manufacturing machine, wherein, the ply machine receives a single-ply continuous sheet having a width plural times or more than a width of a toilet roll from said primary paper roll and comprises:

a chemicals applying unit, which applies chemicals including at least one polyol to the single-ply continuous sheet after it leaves the multi-ply forming unit, and a winding unit, which winds the single-ply continuous sheet applied with the chemicals;

wherein in the ply machine, one primary paper roll is used to form the single-ply continuous sheet, the chemicals are applied to the single-ply continuous sheet reeled out from said one primary paper roll, and the single-ply continuous sheet is then wound so as to manufacture the secondary paper roll comprising the single-ply continuous sheet;

conveying the secondary paper roll to a winder and setting it in a paper roll support portion of said winder; wherein the chemicals spread and are absorbed by the single continuous sheet causing stretching of the single-ply continuous sheet from a stretching of its crepe while the secondary paper roll is being conveyed to and set in the paper roll support portion of the winder; reeling out a single-ply continuous sheet from the secondary paper roll applied with the chemicals, forming perforation lines on the single-ply continuous sheet in the width direction of the single continuous sheet at a predetermined interval, and then rewinding the single-ply continuous sheet with the perforation lines with the winder to a winding diameter of the toilet roll so as to manufacture a log for the toilet roll products;

conveying the log manufactured in the winder to a log cutter and then cutting the log into segments having the width of the toilet roll using the log cutter, thereby forming individual toilet rolls, and putting one or more toilet rolls in a product package so as to obtain the toilet roll products.

12. The method for manufacturing the toilet roll products applied with the chemicals according to claim 11, wherein the ply machine includes an embossing unit positioned after the chemicals applying unit, and the embossing unit performs embossing on the single continuous sheet from the primary paper roll applied with the chemicals.

13. The method for manufacturing the toilet roll products applied with the chemicals according to claim 11, wherein the winder includes an embossing unit and a multi-ply forming unit, which are provided in this order before the perforation line applying unit, and a plurality of secondary paper rolls are set in the winder, and wherein the embossing unit embosses one or more of the single-ply continuous sheets reeled out from the plurality of secondary paper rolls, and then the multi-ply forming unit performs multi-ply forming on the single-ply continuous sheets reeled out from the plurality of secondary paper rolls to form a continuous multi-ply sheet.

14. The method for manufacturing the toilet roll products applied with the chemicals according to claim 11, wherein the winder includes a multi-ply forming unit and an embossing unit, which are provided in this order before the perforation line applying unit, and a plurality of secondary paper rolls are set in the winder, and wherein the multi-ply forming unit performs multi-ply forming on the single-ply continuous sheets reeled out from the plurality of secondary paper rolls set in the winder to form a multi-ply continuous sheet and the embossing unit then performs a single embossing on the multi-ply continuous sheet.

15. The method for manufacturing the toilet roll products applied with the chemicals according to claim 1, wherein the chemicals applying unit is a flexographic printer.

16. The method for manufacturing the toilet roll products applied with the chemicals according to claim 15, wherein the multi-ply continuous sheet is conveyed at a speed of 500 m/minute or higher when the flexographic printer applies chemicals.

17. Toilet roll products, which are manufactured by the manufacturing method according to claim 1.

18. The method for manufacturing the toilet roll products applied with the chemicals according to claim 11, wherein the chemicals applying unit in the ply machine is a flexographic printer.

19. Toilet roll products, which are manufactured by the manufacturing method according to claim 11.

* * * * *